United States Patent [19]

Ohki et al.

[11] Patent Number: 4,833,068

[45] Date of Patent: May 23, 1989

[54] COLOR PHOTOGRAPHIC DEVELOPING SOLUTION COMPOSITION AND METHOD FOR PROCESSING A SILVER HALIDE COLOR PHOTOGRAPHIC MATERIAL

[75] Inventors: Nobutaka Ohki; Kazuto Andoh; Hiroshi Fujimoto, all of Kanagawa, Japan

[73] Assignee: Fuji Photo Film Co., Ltd., Kanagawa, Japan

[21] Appl. No.: 76,430

[22] Filed: Jul. 21, 1987

[30] Foreign Application Priority Data

Jul. 21, 1986 [JP] Japan ..... 61-169789

[51] Int. Cl.[4] ..... G03C 5/24; G03C 7/16

[52] U.S. Cl. ..... 430/484; 430/380; 430/434; 430/435; 430/436; 430/464; 430/467; 430/484; 430/490

[58] Field of Search ..... 430/484, 380, 490, 372, 430/464, 467, 468, 434, 435, 436

[56] References Cited

U.S. PATENT DOCUMENTS

| | | | |
|---|---|---|---|
| 3,615,503 | 10/1971 | Edens et al. | 430/490 |
| 3,746,544 | 7/1973 | Heilmann | 430/490 |
| 4,083,725 | 4/1978 | Shimamura et al. | 430/376 |
| 4,142,895 | 5/1979 | Frank et al. | 430/490 |
| 4,155,764 | 5/1979 | Melzer et al. | 430/490 |
| 4,170,478 | 10/1979 | Case et al. | 430/490 |
| 4,264,716 | 4/1981 | Vincent et al. | 430/490 |
| 4,330,616 | 5/1982 | Kurematsu et al. | 430/488 |
| 4,482,626 | 11/1984 | Twist et al. | 430/490 |
| 4,565,774 | 1/1986 | Kajiwara et al. | 430/489 |

FOREIGN PATENT DOCUMENTS 1306176 2/1973 United Kingdom .

*Primary Examiner*—Mukund J. Shah

*Attorney, Agent, or Firm*—Sughrue, Mion, Zinn, Macpeak and Seas

[57] ABSTRACT

A developing solution composition for a silver halide color photographic material is described, comprising an aromatic primary amine color developing agent and a compound represented by formula (I)

(I)

wherein $R^1$ and $R^2$, which may be the same or different each represents a hydrogen atom or a substituted or unsubstituted alkyl group; $R^3$ represents a substituted or unsubstituted alkylene group; and the total number of carbon atoms contained in $R^1$, $R^2$ and $R^3$ is at least 3.

The color developer composition has improved stability and color forming properties and remarkably limits fog formation during continuous processing.

A method for processing a silver halide color photographic material including the step of developing a silver halide color photographic material comprising a support having thereon at least one silver halide emulsion layer with a developing solution comprising an aromatic primary amine color developing agent and a compound represented by formula (I) described above, and substantially no benzyl alcohol content, is also disclosed.

15 Claims, No Drawings

COLOR PHOTOGRAPHIC DEVELOPING SOLUTION COMPOSITION AND METHOD FOR PROCESSING A SILVER HALIDE COLOR PHOTOGRAPHIC MATERIAL

FIELD OF THE INVENTION

The present invention relates to a color photographic developing solution composition and a method for processing a silver halide color photographic material using it. More particularly, it relates to a color photographic developing solution composition which has improved stability and color forming properties and which reduces fog during continuous processing, and a method for processing using the composition.

BACKGROUND OF THE INVENTION

Color photographic developing solutions (hereinafter referred to as "color developing solutions") containing an aromatic primary amine color developing agent have been conventionally employed in methods of forming color images, and are principally used in methods for forming color photographic images at present. However, these color developing solutions are easily oxidized by air or in the presence of metals. Thus, when color images are formed using a developing solution deteriorated over time, an undesirable increase in fog and changes in sensitivity and gradation occur, and the photographic characteristics differ from those desired, as is well known in the art.

Accordingly, various methods for improving the preservability of color developing solutions have been investigated. Among them, a method in which hydroxylamine and sulfite ions are used together is most commonly employed. However, hydroxylamine decomposes to generate ammonia, which causes fog, and sulfite ions also have the disadvantage that they function as competing compounds with the developing agents and hinder color formation, etc. Therefore, these compounds are not preferred preservatives.

Further, in order to increase the stability of color developing solutions, various preservatives and chelating agents have been investigated. Such preservatives include aromatic polyhydroxy compounds as described in Japanese Patent Application (OPI) Nos. 49828/77, 160142/84 and 47038/81, and U.S. Pat. No. 3,746,544, hydroxycarbonyl compounds as described in U.S. Pat. No. 3,615,503, and British Pat. No. 1,306,176, α-aminocarbonyl compounds as described in Japanese Patent Application (OPI) Nos. 143020/77 and 89425/78, alkanolamines as described in Japanese Patent Application (OPI) No. 3532/79, and metal salts as described in Japanese Patent Application (OPI) Nos. 44148/82 and 53749/82 (the term "OPI" as used herein refers to a "published unexamined Japanese patent application"). Also, chelating agents include aminopolycarboxylic acids as described in Japanese Patent Publication Nos. 30496/73 and 30232/69, organic phosphonic acids as described in Japanese Patent Application (OPI) No. 97347/81, Japanese Patent Publication No. 39359/81, and West German Patent No. 2,227,639, phosphonocarboxylic acids as described in Japanese Patent Application (OPI) Nos. 102726/77, 42730/78, 121127/79, 126241/80 and 65956/80, and compounds described in Japanese Patent Application (OPI) Nos. 195845/83 and 203440/83, and Japanese Patent Publication No. 40900/78.

However, when using these compounds, preservability is insufficient, and they adversely affect photographic characteristics, and thus satisfactory results can not be obtained.

In particular, color developing solutions that do not contain benzyl alcohol which is an environmental pollutant, and does not simplify in preparation, have necessarily reduced color forming properties. In such cases, preservatives which function as competing compounds further reduce color forming properties, and therefore conventional techniques cannot be satisfactorily used.

Further, color photographic light-sensitive materials containing a silver chlorobromide emulsion having a high chloride content tend to form fog upon color development as described in Japanese Patent Application (OPI) Nos. 95345/83 and 232342/84. When employing such silver chlorobromide emulsions, it is essential to use a preservative which has excellent preservation properties. From this point of view as well, a new type of developing solution is desirable.

SUMMARY OF THE INVENTION

Therefore, an object of the present invention is to provide a developing solution composition for a silver halide color photographic material, which has improved stability and color forming properties, and then restrains fog formation during continuous processing.

Another object of the present invention is to provide a color developing solution composition which has improved stability and provides sufficient color density without substantially containing benzyl alcohol.

A further object of the present invention is to provide a method for processing a silver halide color photographic material, in which the stability of a color developing solution is improved, changes in photographic properties over time during continuous processing are remarkably restrained, and fog formation is prevented.

Other objects of the present invention will become apparent from the following description and examples.

It has now been found that these objects of the present invention can be obtained by a developing solution composition for a silver halide color photographic material, comprising an aromatic primary amine color developing agent and a compound represented by formula (I):

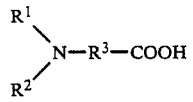

(I)

wherein $R^1$ and $R^2$, which may be the same or different, each represents a hydrogen atom or a substituted or unsubstituted alkyl group; $R^3$ represents a substituted or unsubstituted alkylene group; and the total number of carbon atoms contained in $R^1$, $R^2$ and $R^3$ is at least 3. The invention also relates to a method for processing a silver halide color photographic material comprising the step of developing a silver halide color photographic material comprising a support having thereon at least one silver halide emulsion layer, with a developing solution comprising an aromatic primary amine color developing agent and a compound represented by the formula (I).

DETAILED DESCRIPTION OF THE INVENTION

The compounds represented by formula (I) are now described in detail.

In formula (I), $R^1$ and $R^2$, which may be the same or different, each represents a hydrogen atom, a substituted or unsubstituted alkyl group (preferably having from 1 to 10 carbon atoms), for example, a methyl group, an ethyl group, a hydroxyethyl group, a carboxymethyl group, an N,N-diethylaminoethyl group, a methoxypropyl group, a mesylethly group, a butyl group, an isobutyl group, etc.; $R^3$ represents a substituted or unsubstituted alkylene group (preferably having from 1 to 10 carbon atoms), for example, a methylene group, an ethylene group, a propylene group, a 2-hydroxypropylene group, etc.; and the total number of carbon atoms included in $R^1$, $R^2$ and $R^3$ is at least 3.

$R^1$ and $R^2$ in formula (I) each preferably represents a hydrogen atom, or an unsubstituted alkyl group, a hydroxyalkyl group, an alkoxy alkyl group or a carboxyalkyl group, having from 1 to 10 carbon atoms. Further it is more preferred that at least one of $R^1$ and $R^2$ represent a hydrogen atom, an unsubstituted alkyl group or a hydroxyalkyl group, having from 1 to 10 carbon atoms. Furthermore, it is most preferred that all of $R^1$ and $R^2$ represent a hydrogen atom, an unsubstituted alkyl group or a hydroxyalkyl group, having from 1 to 10 carbon atoms.

$R^3$ in formula (I) preferably represents an unsubstituted alkylene group or an alkylene group substituted with a carboxy group, an amino group or a hydroxy group, having from 1 to 10 carbon atoms.

In the compound represented by formula (I), the total number of carboxy groups included is preferably from 1 to 3 and more preferably from 1 to 2.

The amount of the compound represented by formula (I) to be added to a color developing solution is generally about from about 0.01 g to 50 g, preferably from about 0.1 g to 20 g, and particularly preferably from about 1 g to 15 g, per liter of the developing solution.

Specific examples of the compounds represented by formula (I) are set forth below, but the present invention is not to be construed as being limited thereto.

$(HOC_2H_4)_2N-CH_2COOH$ I-(1)

$HN(CH_2COOH)_2$ I-(2)

$CH_3N(CH_2COOH)_2$ I-(3)

$H_2N(CH_2)_4CH(NH_2)COOH$ I-(4)

$NH_2CH(C_2H_4COOH)COOH$ I-(5)

$HOC_2H_4-N(CH_2COOH)_2$ I-(6)

$(HOC_2H_4)_2N-(CH_2)_2N(CH_2COOH)_2$ I-(7)

$(CH_3OC_2H_4)_2N(CH_2)_3COOH$ I-(8)

$HOC_2H_4-N(CH(C_2H_5)COOH)_2$ I-(9)

$(HOC_2H_4OC_2H_4)_2N(CH_2)_3COOH$ I-(10)

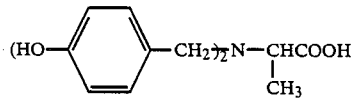
I-(11)

-continued $HOC_2H_4OC_2H_4OC_2H_4-N(C_2H_4COOH)_2$ I-(12)

$C_4H_9N(C_2H_4COOH)(CH_2)_3SO_3H$ I-(13)

$CH_3SO_2C_2H_4N(CH_2COOH)_2$ I-(14)

$(ClC_2H_4)_2N-CH(CH_3)CH_2COOH$ I-(15)

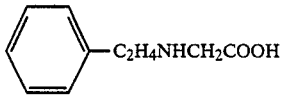
I-(16)

$NH_2(CH_2)_3COOH$ I-(17)

$CH_3NHC_2H_4COOH$ I-(18)

$(CH_3)_2N-CH_2COOH$ I-(19)

$(C_2H_5)_2NCH_2CH(OH)CH_2COOH$ I-(20)

The compounds represented by formula (I) can be synthesized by the synthesis method shown below. The compounds represented by formula (I) which is not available as marketed manufactured goods can be synthesized according to a synthetic example described below.

Synthetic Example: Synthesis of Compound I-(6)

6.1 g of ethanolamine and 23.3 g of sodium chloroacetate were dissolved in 200 ml of water, and then the solution was heated at 70 ° C. while stirring. Further 10.6 g of anhydrous sodium carbonate was gradually added into the solution while being careful in foaming, and was reacted for 30 minutes. The reaction solution was concentrated to obtain 70 ml of a concentrated solution by an evaporator. The concentrated solution was adjusted at a pH value of about 2 by adding hydrochloric acid. The resulting crystals were filtered off, and then recrystallized from water to obtain 12 g of N-hydroxyethyliminoacetic acid (colorless crystals) of the desired compound.

The color developing solution according to the present invention is now described in detail.

The color developing solution used in the present invention may contain any of known aromatic primary mine color developing agents. Preferred examples thereof are p-phenylenediamine derivatives. Typical examples of the p-phenylenediamine derivatives used are set forth below, but the present invention should not be construed as being limited thereto.

D-1 N,N-Diethyl-p-phenylenediamine

D-2 2-Amino-5-diethylaminotoluene

D-3 2-Amino-5-(N-ethyl-N-laurylamino)toluene

D-4 4-[N-Ethyl-N-(β-hydroxyethyl)amino]aniline

D-5 2-Methyl-4-[N-ethyl-N-(β-hydroxyethyl-)amino]aniline

D-6 N-Ethyl-N-(β-methanesulfonamidoethyl)-3-methyl-4-aminoaniline

D-7 N-(2-Amino-5-diethylaminophenylethyl)methanesulfonamide

D-8 N,N-Dimethyl-p-phenylenediamine

D-9 4-Amino-3-methyl-N-ethyl-N-methoxyethylaniline

D-10 4-Amino-3-methyl-N-ethyl-N-β-ethoxyethylaniline

D-11 4-Amino-3-methyl-N-ethyl-N-β-butoxyethylaniline

These p-phenylenediamine derivatives may be in the form of salts such as sulfates, hydrochlorides, sulfites, p-toluenesulfonates, etc. Among the above p-phenylenediamine derivatives, D-2, D-5, D-6, and D-9 were particularly preferred. The aromatic primary amine developing agent is used in an amount of from about 0.1 g to about 20 g, preferably from about 0.5 g to about 10 g, and particularly preferably from about 2 g to 8 g, per liter of a developing solution.

It is preferred that the color developing solution used in the present invention contain a hydroxylamine represented by formula (II):

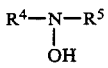

(II)

wherein $R^4$ and $R^5$, which may be the same or different, each represents a hydrogen atom, an unsubstituted or substituted alkyl group, an unsubstituted or substituted alkenyl group or an unsubstituted or substituted aryl group; and $R^4$ and $R^5$ may be connected with each other to form a heterocyclic ring together with the nitrogen atom.

$R^4$ and $R^5$ in formula (II) each preferably represents an unsubstituted or substituted alkyl group or alkenyl group. It is more preferred that at least one of $R^4$ and $R^5$ represents a substituted alkyl group or substituted alkenyl group.

The alkyl group or the alkenyl group represented by $R^4$ or $R^5$ may be a straight chain, branched chain or cyclic form.

Examples of the substituents for the group represented by $R^4$ or $R^5$ include a halogen atom (for example, a fluorine atom, a chlorine atom, a bromine atom, etc.), an aryl group (for example, a phenyl group, a p-chlorophenyl group, etc.), an alkoxy group (for example, a methoxy group, an ethoxy group, a methoxyethoxy group, etc.), an aryloxy group (for example, a phenoxy group, etc.), a sulfonyl group (for example, a methanesulfonyl group, p-toluenesulfonyl group, etc.), a sulfonamido group (for example, a methanesulfonamide group, a benzenesulfonamide group, etc.), a sulfamoyl group (for example, a diethylsulfamoyl group, an unsubstituted sulfamoyl group, etc.), a carbamoyl group (for example, an unsubstituted carbamoyl group, a diethylcarbamoyl group, etc.), an amide group (for example, an acetamide group, benzamide group, etc.), a ureido group (for example, a methylureido group, a phenylureido group, etc.), an alkoxycarbonylamino group (for example, a methoxycarbonylamino group, etc.), an aryloxycarbonylamino group (for example, a phenoxycarbonylamino group, etc.), an alkoxycarbonyl group (for example, a methoxycarbonyl group, etc.), an aryloxycarbonyl group (for example, a phenoxycarbonyl group, etc.), a cyano group, a hydroxy group, a carboxy group, a sulfo group, a nitro group, an amino group (for example, an unsubstituted amino group, a diethylamino group, etc.), an alkylthio group (for example, a methylthio group, etc.), an arylthio group (for example, a phenylthio group, etc.), or a heterocyclic group (for example, a morpholino group, a pyridyl group, etc.), etc. The substituents included in $R^4$ and $R^5$ may be the same or different.

It is preferred that the total number of carbon atoms included in $R^4$ or $R^5$ is from 1 to 10, and particularly from 1 to 5.

Therefore, preferred $R^4$ and $R^5$ in formula (II) each include a hydrogen atom, or an unsubstituted or substituted alkyl group, an unsubstituted or substituted alkenyl group or an unsubstituted or substituted aryl group, having from 1 to 10 carbon atoms.

Examples of the nitrogen-containing heterocyclic groups formed by connecting $R^4$ and $R^5$ include a piperidyl group, a pyrrolidinyl group, an N-alkylpiperazinyl group, a morpholinyl group, an indolinyl group, a benzotriazolyl group, etc.

Preferred substituents for the group represented by $R^4$ or $R^5$ include a hydroxy group, an alkoxy group, an alkyl sulfonyl group, an arylsulfonyl group, an amide group, a carboxy group, a cyano group, a sulfo group, a nitro group and an amino group.

Specific examples of the compounds represented by formula (II) are set forth below, but the present invention is not to be construed as being limited thereto.

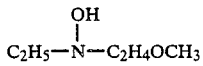

II-(1)

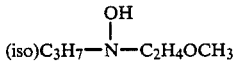

II-(2)

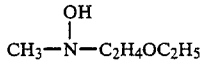

II-(3)

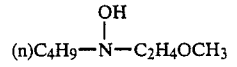

II-(4)

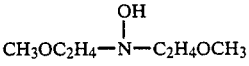

II-(5)

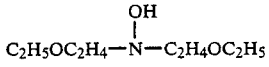

II-(6)

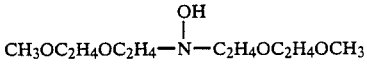

II-(7)

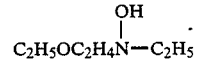

II-(8)

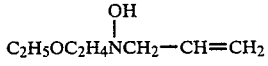

II-(9)

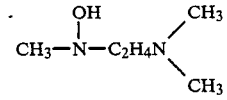

II-(10)

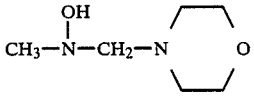

II-(11)

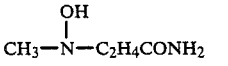

II-(12)

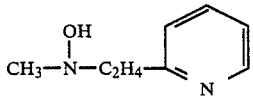

II-(13)

-continued

II-(14)

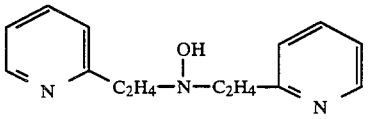

II-(15)

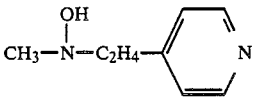

II-(16)

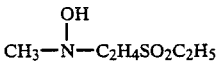

II-(17)

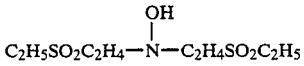

II-(18)

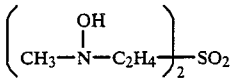

II-(19)

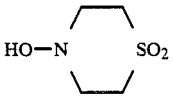

II-(20)

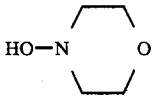

II-(21)

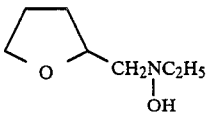

II-(22)

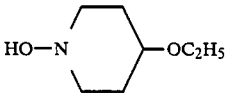

II-(23)

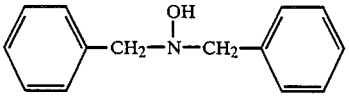

II-(24)

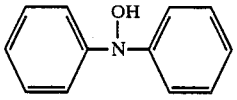

II-(25)

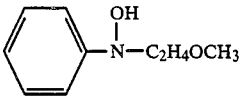

II-(26)

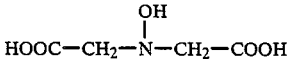

II-(27)

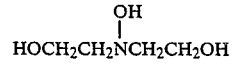

II-(28)

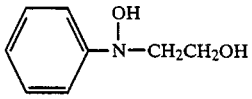

-continued

II-(29)

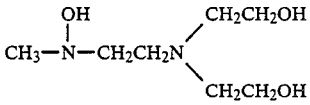

II-(30)

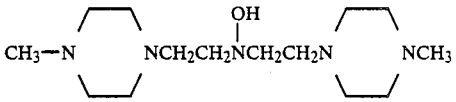

II-(31)

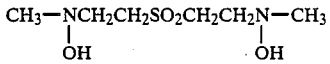

II-(32)

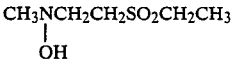

II-(33)

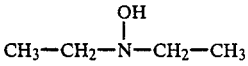

II-(34)

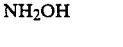

The compounds represented by formula (II) can be synthesized by known methods as described in U.S. Pat. Nos. 3,661,996, 3,362,961, 3,293,034, 3,491,151, 3,655,764, 3,467,711, 3,455,916, 3,287,125 and 3,284,124, Japanese Patent Publication No. 2794/67, etc.

The hydroxylamine compounds represented by formula (II) may be in the form of salts with various acids such as hydrochloric acid, sulfuric acid, nitric acid, phosphoric acid, oxalic acid, acetic acid, etc.

The amount of the compound represented by formula (II) to be added to a color developing solution is generally from about 0.1 g to 20 g preferably from about 0.5 g to 10 g per liter of the solution.

The color developing solution according to the present invention preferably contains substantially no benzyl alcohol in order to prevent environmental pollution, simplify preparation of the solution, and prevent the formation of fog. The term "color developing solution having substantially no benzyl alcohol content" as used herein means a color developing solution containing benzyl alcohol in an amount of not more than about 2 ml per liter of the solution and preferably a color developing solution which contains no added benzyl alcohol.

Further, the color developing solution used in the present invention may contain sulfites such as sodium sulfite, potassium sulfite, sodium bisulfite, potassium bisulfite, sodium metasulfite, potassium metasulfite etc., or carbonyl-sulfite adducts, as preservatives, if desired. The amount of these compounds added is usually from 0 g to about 20 g, and preferably from 0 g to about 5 g, per liter of the color developing solution. It is preferred to add these compounds in a reduced amount only sufficient to maintain the stability of color developing solution.

Examples of other usable preservatives include hydroxyccetones as described in U.S. Pat. No. 3,615,503 and British Patent No. 1,306,176; α-aminocarbonyl compounds as described in Japanese Patent Application (OPI) Nos. 143020/77 and 89425/78; various metals as described in Japanese Patent Application (OPI) Nos. 44148/82 and 53749/82; various saccharides as described in Japanese Patent Application (OPI) No. 102727/77; hydroxamic acids as described in Japanese Patent Application (OPI) No. 27638/77; α,α'-dicarbonyl compounds as described in Japanese Patent Application (OPI) No. 160141/84; salicyclic acids as described in Japanese Patent Application (OPI) No. 180588/84; alkanolamines as described in Japanese Patent Application (OPI) No. 3532/79; poly(alkyleneimines) as described in Japanese Patent Application (OP) No. 94349/81; gluconic acid derivatives as described in Japanese Patent Application (OPI) No. 75647/81; and the like.

Two or more of such preservatives may be employed together, if desired.

Also, it is preferred to add aromatic polyhydroxy compounds such as catechole-3,5-disulfonic acid, catechol-3,4,6-trisulfonic acid, etc., to the color developing solution.

The color developing solution used in the present invention has a pH which ranges preferably from about 9 to 12, and more preferably from about 9 to 11.0. The color developing solution may also contain any other conventional compounds that are commonly used as components of developing solutions.

In order to maintain the pH in the above described range, various buffers can be preferably employed, including carbonates, phosphates, borates, tetraborates, hydroxybenzoates, glycine salts, N,N-dimethylglycine salts, leucine salts, norleucine salts, guanine salts, 3,4-dihydroxylphenylalanine salts, alanine salts, aminobutyrates, 2-amino-2-methyl-1,3-propanediol salts, valine salts, proline salts, trishydroxyaminomethane salts, lysine salts, etc. Particularly, carbonates, phosphates, tetraborates and hydroxybenzoates are preferably employed since they have good solubility and excellent buffering capability in a high pH range such as 9.0 or more, they do not adversely affect on photographic characteristics (such as fog formation) when are added to the color developing solution and they are inexpensive.

Specific examples of these buffers include sodium carbonate, potassium carbonate, sodium bicarbonate, potassium bicarbonate, trisodium phosphate, tripotassium phosphate, disodium phosphate, dipotassium phosphate, sodium borate, potassium borate, sodium tetraborate (borax), potassium tetraborate, sodium o-hydroxybenzoate (sodium salicylate), potassium o-hydroxybenzoate, sodium 5-sulfo-2-hydroxybenzoate (sodium 5-sulfosalicylate), potassium 5-sulfo-2-hydroxybenzoate (potassium 5-sulfosalicylate), etc. The present invention, however, is not limited to these compounds.

The amount of buffers to be added to the color developing solution is preferably about 0.1 mol or more, and more preferably from about 0.1 to 0.4 mol, per liter of the color developing solution.

In addition, various conventional chelating agents can be used in the color developing solution according to the present invention for the purpose of preventing calcium or magnesium precipitation, or increasing the stability of the color developing solution.

As chelating agents, organic acid compounds are preferred, which include, for example, aminopolycarboxylic acids as described in Japanese Patent Publication Nos. 30496/73 and 30232/69, etc.; organic phosphonic acids as described in Japanese Patent Application (OPI) No. 97347/81, Japanese Patent Publication No. 39359/81, and West German Patent No. 2,227,639; phosphonocarboxylic acids as described in Japanese Patent Application (OPI) Nos. 102726/77, 42730/78, 121127/79, 126241/80 and 65956/80; and compounds as described in Japanese Patent Application (OPI) Nos. 195845/83 and 203440/83, and Japanese Patent Publication No. 40900/78.

Specific examples of the chelating agents used are set forth below, but the present invention is not to be construed as being limited thereto.

Nitrilotriacetic acid
Diethylenetriaminepentaacetic acid
Ethylenediaminetetraacetic acid
Triethylenetetraminehexaacetic acid
N,N,N-trimethylenephosphonic acid
Ethylenediamine-N,N,N',N'-tetramethylenephosphonic acid
1,3-Diamino-2-propanoltetraacetic acid
Trans-cyclohexanediaminetetraacetic acid
Nitrilotripropionic acid
1,2-Diaminopropanetetraacetic acid
Hydroxyethyliminodiacetic acid
Glycol ether diaminetetraacetic acid
Hydroxyethylediaminetriacetic acid
Ethylenediamine o-hydroxyphenylacetic acid
2-Phosphonobutane-1,2,4-tricarboxylic acid
1-Hydroxyethylidene-1,1-diphosphonic acid
N,N'-Bis(2-hydroxybenzyl)ethylenediamine-N,N'-diacetic acid Two or more of such chelating agents may be employed together, if desired. The chelating agent can be added to the color developing solution in an amount sufficient to mask metal ions present therein. For example, a range from about 0.1 g to about 10 g per liter of the color developing solution is generally employed.

The color developing solution may contain appropriate development accelerators, if desired, including e.g., thioether type compounds as described in Japanese Patent Publication Nos. 16088/62, 5987/62, 7826/63, 12380/69 and 9019/70, and U.S. Pat. No. 3,813,247; p-phenylenediamine type compounds as described in Japanese Patent Application (OPI) Nos. 49829/77 and 15554/75; quaternary ammonium salts as described in Japanese Patent Application (OPI) Nos. 137726/75, 156826/81 and 43429/77, and Japanese Patent Publication No. 30074/69; p-aminophenols as described in U.S. Pat. Nos. 2,610,122 and 4,119,462; amine type compounds as described in U.S. Pat. Nos. 2,494,903, 3,128,182, 4,230,796, 3,253,919, 2,482,546, 2,596,926 and 3,582,346, and Japanese Patent Publication No. 11431/66; polyalkylene oxides as described in Japanese Patent Publication Nos. 16088/62, 25201/67, 11431/66 and 23883/67, and U.S. Pat. Nos. 3,138,183 and 3,532,501; 1-phenyl-3-pyrazolidones; hydrazines, mesoionic type compounds; ionic type compounds; imidazoles; etc.

The color developing solution used in the present invention may contain appropriate antifoggants in an amount of generally from 1 mg to 10 g and preferably from 10 mg to 1 g, per liter of the color developing solution, if desired. Alkali metal halides such as sodium chloride, potassium bromide and potassium iodide, etc. as well as organic antifoggants may be employed as antifoggants. Useful representative examples of organic antifoggants include nitrogen-containing heterocyclic compounds such as benzotriazole, 6-nitrobenzimidazole, 5-nitro-iosindazole, 5-methylbenzotriazole, 5-nitrobenzotriazole, 5-chlorobenzotriazole, 2-thiazolylbenzimidazole, 2-thiazolylmethylbenzimidazole, an indazole, hydroxyazaindolizine, adenine, etc.

It is preferred that the color developing solutions according to the present invention contain fluorescent brightening agents. As fluorescent brightening agents, 4,4'-diamino-2,2'-disulfostilbene type compounds are preferred, The amount of fluorescent brightening agents to be added is preferably from about 0 to 5 g per liter, and more preferably from about 0.1 g to 4 g, per liter of the color developing solution.

Furthermore, the color developing solution according to the present invention may contain various surface active agents such as alkylphosphonic acids, arylphosphonic acids, aliphatic carboxylic acids, aromatic carboxylic acids, etc., if desired.

The processing temperature of the color developing solution used in the present invention is preferably from about 20° C. to 50° C., and more preferably from about 30° C. to 40° C. The processing time is preferably from about 20 seconds to 5 minutes, and more preferably from about 30 seconds to 2 minutes. Further, a suitable amount of replenisher for the color developing solution is usually from about 20 ml to 600 ml, preferably from about 50 ml to 300 ml and more preferably from about 100 ml to 200 ml, per square meter of the color photographic light-sensitive material, the smaller amount being preferred.

A bleaching solution, a bleach-fixing solution and a fixing solution which can be employed in the processing method according to the present invention are now described in greater detail.

Any conventional bleaching agents can be employed as bleaching agents in a bleaching solution or a bleach-fixing solution used in the present invention. Particularly, organic complex salts of iron (III), for example, complex salts of aminopolycarboxylic acids (e.g., ethylenediaminetetraacetic acid, diethylenetriaminepentaacetic acid, etc.), aminopolyphosphonic acids, phosphonocarboxylic acids and organic phosphonic acids, etc. or complex salts of organic acids (e.g., citric acid, tartaric acid, malic acid, etc.); persulfates; hydrogen peroxide; etc. are preferably used. Of these compounds, organic complex salts of iron (III) are particularly preferred for rapid processing and prevention of environmental pollution.

Specific examples of useful aminopolycarboxylic acids, aminopolyphosphonic acids, organic phosphonic acids or salts thereof suitable for forming organic complex salts of iron (III) are set forth below, although the present invention is not limited thereto.

Ethylenediaminetetraacetic acid
Diethylenetriaminepentaacetic acid
Ethylenediamine-N-(β-oxyethyl)-N,N',N'-triacetic acid
1,3-Diaminopropanetetraacetic acid
Triethylenetetraminehexaacetic acid
Propylenediaminetetraacetic acid
Nitrilotriacetic acid
Nitrilotripropionic acid
Cyclohexanediaminetetraacetic acid
1,3-Diamino-2-propanoltetraacetic acid
Methyliminodiacetic acid
Iminodiacetic acid
Hydroxyliminodiacetic acid
Dihydroxyethylglycineethyl ether diaminetetraacetic acid
Glycol ether diaminetetraacetic acid
Ethylenediaminetetrapropionic acid
Ethylenediaminedipropionic acid
Phenylenediaminetetraacetic acid
2-Phosphonobutane-1,2,4-triacetic acid
1,3-Diaminopropanol-N,N,N',N'-tetramethylenephosphonic acid
Ethylenediamine-N,N,N',N'-tetramethylenephosphonic acid
1,3Propylenediamine-N,N,N',N'-tetramethylenephosphonic acid
1-Hydroxyethylidene-1,1'-diphosphonic acid These compounds may be in the form of salts such as sodium, potassium, lithium or ammonium, salts of the above acids.

Of these compounds, iron (III) complex salt of ethylenediaminetetraacetic acid, diethylenetriaminepentaacetic acid, cyclohexanediaminetetraacetic acid, 1,3-diaminopropanetetraacetic acid and methyliminodiacetic acid are preferred because of having their high bleaching power.

The ferric ion complex salts may be added in the form of a complex salt per se or may be formed in situ in solution by using a ferric salt (e.g., ferric sulfate, ferric chloride, ferric nitrate, ferric ammonium sulfate or ferric phosphate, etc.) and a chelating agent (e.g., an aminopolycarboxylic acid, aminopolyphosphonic acid or phosphonocarboxylic acid, etc.). When they are used in the form of a complex salt, they may be used alone or as a combination of two or more thereof. Where a complex is formed in situ in solution by using a ferric salt and a chelating agent, one, two or more ferric salts may be used, and one, two or more chelating agents may also be used. In each case, the chelating agent may be used in an excess amount of being necessary for forming a ferric ion complex salt.

Of the ferric ion complexes, ferric complexes of aminopolycarboxylic acids are preferred. The amount of the ferric ion complex in the bleaching solution or bleach-fixing solution is from about 0.01 mol to 1.0 mol, and preferably from about 0.05 mol to 0.50 mol, per liter of the solution.

In the bleaching solution or the bleach-fixing solution, a bleach accelerating agent can be used, if desired. Specific examples of suitable bleach accelerating agents include compounds having a mercapto group or a disulfide group as described in U.S. Pat. No. 3,893,858, West German Patent Nos.1,290,812 and 2,059,988, Japanese Patent Application (OPI) Nos. 32736/78, 57831/78, 37418/78, 65732/78, 72623/78, 95630/78, 95631/78, 104232/78, 124424/78, 141623/78 and 28426/78, *Research Disclosure*, No. 17129 (July, 1978), etc.; thiazolidine derivatives as described in Japanese Patent Application (OPI) No. 14029/75, etc.; thiourea derivatives as described in Japanese Patent Publication No. 8506/70, Japanese Patent Application (OPI) Nos. 20832/77 and 32735/78, U.S. Pat. No. 3,706,561, etc.; iodides as described in West German Patent 1,127,715, Japanese Patent Application (OPI) No. 16235/83, etc.; polyethyleneoxides as described in West German Patent Nos. 966,410 and 2,748,430, etc.; polyamine compounds as described in Japanese Patent Publication No. 8836/70, etc.; compounds as described in Japanese Patent Application (OPI) Nos. 42434/74, 59644/74, 94927/78, 35727/79, 26506/80 and 163940/83; iodine ions; and bromine ions, etc. Of these compounds, the compounds having a mercapto group or a disulfide group are preferred in view of their large bleach accelerating effects. Particularly, the compounds as described in U.S. Pat. No. 3,893,858, West German Patent No. 1,290,812 and Japanese Patent Application (OPI) No. 95630/78 are preferred.

The bleaching solution or bleach-fixing solution used in the present invention can contain rehalogenating agents such as bromides (e.g., potassium bromide, sodium bromide, ammonium bromide, etc.), chlorides (e.g., potassium chloride, sodium chloride, ammonium chloride, etc.) or iodides (e.g., ammonium iodide, etc.). Further, one or more inorganic acids, organic acids, alkali metal salts thereof or ammonium salts thereof which have a pH buffering ability (e.g., boric acid, borax, sodium metaborate, acetic acid, sodium acetate, sodium carbonate, potassium carbonate, phosphorous acid, phosphoric acid, sodium phosphate, citric acid, sodium citrate, tartaric acid, etc.), corrosion preventing agents (e.g., ammonium nitrate, guanidine, etc.), or the like may be added, if desired.

The fixing agents which can be employed in the bleach-fixing solution or fixing solution, include any known fixing agents, e.g., water-soluble silver halide solvents such as thiosulfates (e.g., sodium thiosulfate, ammonium thiosulfate, etc.); thiocyanates (e.g., sodium thiocyanate, ammonium thiocyanate, etc.); thioether compounds (e.g., ethylenebisthioglycolic acid, 3,6-dithia-1,8-octanediol, etc.); and thioureas may be used invidividually or in a combination of two or more thereof. In addition, a special bleach-fixing solution comprising a combination of a fixing agent and a large amount of a halide compound such as potassium iodide as described in Japanese Patent Application (OPI) No. 155354/80 can be used. In the present invention, a thiosulfate, and particularly ammonium thiosulfate, is preferably employed.

The amount of fixing agent used in the bleach fixing solution or fixing solution is preferably from about 0.3 mol to 2 mol, and more preferably from about 0.5 ml to 1.0 mol, per liter of the solution.

The pH of the bleach-fixing solution or fixing solution used in the present invention is preferably from about 3 to 10, and more preferably from about 5 to 9. When the pH of the bleach-fixing solution or fixing solution is lower than this value, desilvering property is increased but degradation of the solution tends to occur and the formation of leuco dyes of cyan dyes is accelerated. On the contrary, when the pH is higher than this value, slowed desilvering and an increase in staining are likely to occur.

In order to adjust the pH, the bleach-fixing solution or fixing solution may contain, if desired, hydrochloric acid, sulfuric acid, nitric acid, acetic acid, a bicarbonate, ammonia, potassium hydroxide, sodium hydroxide, sodium carbonate, potassium carbonate, etc. Further, various kinds of fluorescent brightening agents, defoaming agents and surface active agents, polyvinyl pyrrolidone, organic solvents (e.g., methanol, etc.), etc. may be incorporated into the bleach-fixing solution or fixing solution.

The bleach-fixing solution or fixing solution used in the present invention can contain, as preservatives, compounds capable of releasing sulfite ions such as sulfites (e.g., sodium sulfite, potassium sulfite, ammonium sulfite, etc.), bisulfites (e.g., ammonium bisulfite, sodium bisulfite, potassium bisulfite, etc.), metabisulfites (e.g., potassium metabisulfite, sodium metabisulfite, ammonium metabisulfite, etc.), etc. The amount of such a compound added is preferably from about 0.02 mol to about 0.50 mol, and more preferably from about 0.04 mol to 0.40 mol, per liter of the solution calculated in terms of sulfite ion.

While it is typical to add sulfites as preservatives, other compounds such as ascorbic acid, a carbonyl-bisulfic acid adduct, a carbonyl compound, etc. may be added, if desired.

Further, buffers, antimolds, etc. may be added, if desired.

A water washing step which can be utilized in the present invention is described below.

According to the present invention, a simplified processing method, for example, a method in which only a stabilizing process is conducted, without carrying out a separate water washing step, can be employed in place of a conventional water washing process. The term "water washing step" as used herein broadly describes both conventional and simplified processes.

It is difficult to specify the amount of washing water used in the present invention, since it can be varied depending on the number of baths employed in a multi-stage countercurrent water washing process and the amount of the preceding bath components being carried over with the photographic light-sensitive material. However, it is generally sufficient for the present invention that the amount of the bleaching solution components and fixing solution components is not more than about $1\times10^{-4}$ vol/vol in the final water washing bath. For example, in the case of a countercurrent water washing process using three tanks, the amount of water to be used is preferably about 1,000 ml or more, and more preferably about 5,000 ml or more, per square meter of the photographic light-sensitive material. Further, it is preferred to use from about 100 ml to 1,000 ml of water per square meter of the photographic light-sensitive material in a water-saving process.

The temperature of the water washing step is in a range from about 15° C. to 45° C., and preferably from about 20° C to 35° C.

In the water washing step used in the present invention, various known compounds may be employed for the purpose of preventing the formation of precipitation or stabilizing the washing water. Examples of such additives include a chelating agent such as an inorganic phosphoric acid, an aminopolycarboxylic acid, an organic phosphonic acid, etc.; a germicide or a fungicide for preventing the propagation of various bacteria, fungi and algae (for example, the compounds as described in *J. Antibact. Antifung. Agents,* Vol. 11, No. 5, pages 207 to 223 (1983) or the compounds as described in Hiroshi Horiguchi, *Antibacterial and Antifungal Chemistry*); a metal salt including a magnesium salt or an aluminium salt, etc.; an alkali metal or ammonium salt; or a surface active agent for reducing drying load or preventing drying marks; or the like. Further, the compounds described in L. E. West, *Phot. Sci. Eng.,* Vol. 6, pages 344 to 359 (1965) may be added thereto.

Further, the present invention is particularly effective when the water washing step is carried out by a multi-stage countercurrent water washing process using two or more tanks with washing water to which a chelating agent, a germicide or a fungicide is added for the purpose of remarkably reducing the amount of washing water. Moreover, the present invention is also particularly effective in the case wherein a multi-stage countercurrent stabilizing step ("stabilizing process") as described in Japanese Patent Application (OPI) No. 8543/82 is used in place of a conventional water washing step. In these cases, the amount of the bleaching and fixing components in the final bath is not more than about $5\times10^{-2}$ vol/vol, preferably not more than about $1\times10^{-2}$ vol/vol.

To the stabilizing bath used, various compounds may be added for the purpose of stabilizing the images formed. Representative examples of such compounds include various buffers (for example, borates, metaborates, borax, phosphates, carbonates, potassium hydroxide, sodium hydroxide, aqueous ammonia, monocarboxylic acids, dicarboxylic acids, polycarboxylic acids, etc. being used alone or in combination) in order to adjust the pH of layers of the photosensitive material (for example, to a pH of about 3 to 8); and aldehydes such as formalin, etc. In addition, various additives, for example, a chelating agent (e.g., an inorganic phosphonic acid, an aminopolycarboxylic acid., an organic phosphonic acid, an aminopolyphosphonic acid, a phosphonocarboxylic acid, etc.), a germicide (e.g., those of thiazole type, isothiazole type, halogenated phenol type, sulfanilamide type, benzotriazole type, etc.), a surface active agent, a fluorescent brightening agent, a hardening agent, etc. may be employed. Two or more compounds for the same purpose or different purposes may be employed in combination.

Further, it is preferred to add various ammonium salts such as ammonium chloride, ammonium nitrate, ammonium sulfate, ammonium phosphate, ammonium sulfite, ammonium thiosulfate, etc., as pH adjusting agents for layers of the photosensitive materials after development processing, in order to improve image preservability.

When the amount of washing water is greatly reduced as described above, it is preferred that a part or all of overflow from the washing water be introduced into the bleach-fixing bath or fixing bath, which is the preceding bath, for the purpose of reducing the amount of discharge.

Moreover, in the case of continuous processing in the present invention, variation of the composition of each processing solution can be prevented by using a replenisher for each processing solution, whereby consistent results (e.g., constant finish) can be achieved. The amount of replenisher used can be reduced to one half or less of the standard amount of replenishment in order to reduce costs, etc.

In each of the processing baths, any of various conventional processing apparatives can be used including e.g., a heater, a temperature sensor, a liquid level sensor, a circulation pump, a filter, a floating cover, a squeezer, a nitrogen gas stirrer, an air stirrer, etc.

The method according to the present invention can be applied to any processing method employing a color developing solution. For example, it can be utilized in processing of a color paper, a color reversal paper, color positive films, color negative films, color reversal films, etc.

The silver halide emulsion of the photographic light-sensitive material to which the processing method according to the present invention is applied, can contain a silver halide having any known halogen composition, such as silver iodobromide, silver bromide, silver chlorobromide, silver chloride, etc. However, when conducting rapid processing or processing with a low level of replenishment, a silver chlorobromide emulsion containing at least about 60 mol % of silver chloride, and a silver chloride emulsion are preferred, and a silver halide emulsion having a silver chloride content of from about 80 to 100 mol % is particularly preferred.

On the other hand, if high sensitivity is required and it is necessary to control fog formation during the preparation, preservation and/or processing of the photographic light-sensitive material at a particularly low level, a silver chlorobromide emulsion containing at least about 50 mol % of silver bromide and a silver bromide emulsion are preferred; and a silver halide emulsion having a silver bromide content of at least about 70 mol % is more preferred. Although rapid processing becomes difficult when the silver bromide content in the emulsion used exceeds 90 mol %, the development rate can be increased to some extent without the limitation on silver bromide content by using a development accelerator, for example, the combination of a silver halide solvent, a fogging agent, a development accelerating agent such as a developing aid as described hereinafter, present at the time of processing. This method is sometimes preferred.

In any case, the silver iodide content in the emulsion is desirably not more than about 3 mol %.

Silver halide grains in the silver halide emulsion which can be used in the present invention may have different compositions in their interior and surface portions, multi-phase structures containing junctions, or may be uniform throughout the grains. Further, a mixture of these silver halide grains having different structures . may be employed.

The average grain size of silver halide grains used in the present invention (the grain size being defined as grain diameter if the grain has a spherical or a nearly spherical form, and as the length of the edge if the grain has a cubic form, and being averaged based on the projected areas of the grains) is preferably from about 0.1 μm to 2 μm, and particularly from about 0.15 μm to 1.5 μm.

The grain size distribution may be either narrow or broad. It is preferred to employ a monodisperse silver haldie emulsion in which the coefficient of variation (obtained by dividing the standard deviation derived from a grain size distribution curve of a silver halide emulsion by the average grain size) is about 20% or less and particularly about 15% or less, in the present invention.

Further, in order to achieve the desired gradation of the light-sensitive material, two or more monodisperse silver halide emulsions which have substantially the same spectral sensitivity but have different grain sizes can be mixed in one emulsion layer or can be coated in the form of superimposed layers. Emulsions having the coefficient of variation described above are preferred. Moreover, two or more polydisperse silver halide emulsions, or combinations of a monodisperse emulsion and a polydisperse emulsion may be employed in a mixture thereof or in the form of superimposed layers.

Silver halide grains which can be used in the present invention may have a regular crystal structure, for example, a cubic, octahedral, rhombic dodecahedral or tetradecahedral structure, etc.; an irregular crystal structure, for example, a spherical structure, etc.; or a composite structure thereof. Further, tabular silver halide grains can be used. Particularly, a silver halide emulsion containing tabular silver halide grains having a ratio of diameter/thickness of not less than about 5, preferably not less than about 8 occupying at least about 50% of the total projected area of the silver halide grains present can be employed. In addition, mixtures of silver halide grains having different crystal structures may be used. These silver halide emulsions may be either surface latent image type emulsions in which latent images are formed mainly on the surface of grains, or internal latent image type emulsions in which latent images are formed mainly in the interior of the grains.

The photographic emulsions in materials processed by the present invention can be prepared in any suitable manner, for example, by the methods as described in P. Glafkides, *Chimie et Physique Photographique,* Paul Montel (1967), G. F. Duffin, *Photographic Emulsion Chemistry,* The Focal Press (1966), and V. L. Zelikman et al., *Making and Coating Photographic Emulsion,* The Focal Press (1964), etc. That is, any of an acid process, a neutral process, an ammonia process, etc., can be employed.

Soluble silver salts and soluble halogen salts can be reacted by conventional techniques such as a single jet method, a double jet method, and a combination thereof. In addition, a reversal mixing method in which silver halide grains are formed in the presence of an excess of silver ions can be used. As one double jet method, a controlled double jet method, in which the pAg in the liquid phase where silver halide is formed is maintained at a predetermined level, can be employed to prepare a silver halide emulsion in which the crystal form is regular and the particle size is nearly uniform.

Further, a silver halide emulsion which is prepared by a conversion method may be used, in which silver halide previously formed is converted to silver halide having a lower solubility product before the completion of formation of silver halide grains, or a silver halide emulsion which is subjected to similar halogen conversion after the completion of formation of silver halide grains may also be employed.

During the step of formation or physical ripening of silver halide grains, any of cadmium salts, zinc salts, lead salts, copper salts, thallium salts, iridium salts or complex salts thereof, rhodium salts or complex salts thereof, iron salts or complex salts thereof, etc. may be present.

After the formation of silver halide grains, silver halide emulsions are usually subjected to physical ripening, removal of soluble salts and chemical ripening and then used for coating.

Known silver halide solvents (for example, ammonia, potassium thiocyanate, and thioethers and thione compounds as described in U.S. Pat. No. 3,271,157, Japanese Patent Application (OPI) Nos. 12360/76, 82408/78, 144319/78, 100717/79 and 155828/79, etc.) can be present during the step of formation, physical ripening or chemical ripening of silver halide.

For removal of soluble silver salts from the emulsion after physical ripening, a noodle washing process, a flocculation process or an ultrafiltration process, etc. can be employed.

The silver halide emulsion which can be processed according to the present invention is typically sensitized using, e.g., a sulfur sensitization method using active gelatin or compounds containing sulfur capable of reacting with silver (for example, thiosulfates, thioureas, mercapto compounds and rhodanines, etc.); a reduction sensitization method using reducing substances (for example, stannous salts, amines, hydrazine derivatives, formamidinesulfinic acid and silane compounds, etc.); a noble metal sensitization method using metal compounds (for example, complex salts of Group VIII metals in the Periodic Table, such as Pt, Ir, Pd, Rh, Fe, etc., as well as gold complex salts); and so forth, alone or in combination with each other.

Each of blue-sensitive, green sensitive and red-sensitive emulsions used in the present invention can be spectrally sensitized with methine dyes or other dyes. Suitable dyes which can be employed include cyanine dyes, merocyanine dyes, complex cyanine dyes, complex merocyanine dyes, holopolar cyanine dyes, hemicyanine dyes, styryl dyes, and hemioxonol dyes. Of these dyes, cyanine dyes, merocyanine dyes and complex merocyanine dyes are particularly useful.

Any conventionally utilized nuclei for cyanine dyes can be present in these dyes as basic heterocyclic nuclei, including, e.g., a pyrroline nucleus, an oxazoline nucleus, a thiazoline nucleus, a pyrrole nucleus, an oxazole nucleus, a thiazole nucleus, a selenazole nucleus, an imidazole nucleus, a tetrazole nuclus, a pyridine nucleus, etc.; and further, nuclei formed by condensing aliphatic hydrocarbon rings with these nuclei and nuclei formed by condensing aromatic hydrocarbon rings with these nuclei, such as an indolenine nucleus, a benzindolenine nucleus, an indole nucleus, a benzoxazole nucleus, a naphthoxazole nucleus, a benzothiazole nucleus, a naphthothiazole nucleus, a benzoselenazole nucleus, a benzimidazole nucleus, a quinoline nucleus, etc. The carbon atoms of these nuclei can also be substituted.

The merocyanine dyes and the complex merocyanine dyes that can be employed contain 5- or 6-membered heterocyclic nuclei such as a pyrazolin-5-one nucleus, a thiohydantoin nucleus, a 2-thioxazolidin-2,4-dione nucleus, a thiazolidone-2,4-dione nucleus, a rhodanine nucleus, a thiobarbituric acid nucleus, and the like, as nuclei having a keto-methylene structure.

These sensitizing dyes can be used alone and can also be employed in combination. A combination of sensitizing dyes is often used, particularly for the purpose of supersensitization. Typical examples of supersensitizing combinations are described in U.S. Pat. Nos. 2,688,545, 2,977,229, 3,397,060, 3,522,052, 3,527,641, 3,617,293, 3,628,964, 3,166,480, 3,672,898, 3,679,428, 3,703,377, 3,769,301, 3,814,609, 3,837,862 and 4,026,707, British Patent Nos. 1,344,281 and 1,507,803, Japanese Patent Publication Nos. 4936/68 and 12365/78, Japanese Patent Application (OPI) Nos. 110618/77 and 109925/77, etc.

The sensitizing dyes may be present in the emulsion together with dyes which themselves do not have a spectrally sensitizing effect but that exhibit a supersensitizing effect, or materials which do not substantially absorb visible light but exhibit a supersensitizing effect.

The sensitizing dyes can be added to the silver halide emulsion at any stage of production of the photographic light-sensitive material, that is, during the formation of grains, before, during or after chemical sensitization or during coating. Addition during the formation of grains is effective not only for increased adsorption but also for control of the crystal form and internal structure of the grains. Further, addition during chemical sensitization is effective not only for increased adsorption but also for control of the chemical sensitization site and preventing modification of the crystals. These addition methods are particularly effective for emulsions containing silver chloride in a high ratio, as well as grains having an increased silver bromide content or silver iodide content on the surface thereof.

It is preferable that photographic light-sensitive materials processed according to the invention contain couplers that are rendered diffusion resistant by means of a ballast group or polymerization. It is also preferred that the coupling active positions of couplers be substituted with a group capable of being released (two-equivalent couplers), rather than with a hydrogen atom (four-equivalent couplers), to reduce the coating amount of silver required. Further, couplers which form dyes having an appropriate diffusibility, non-color forming couplers, or couplers capable of releasing development inhibitors (DIR couplers) or development accelerators by a coupling reaction can be employed.

Typical yellow couplers used in materials processed according to the present invention include oil protected acylacetamide type couplers, such as those described in U.S. Pat. Nos. 2,407,210, 2,875,057 and 3,265,506, etc. In the present invention, two-equivalent yellow couplers are preferably employed, including yellow oxygen atom releasing couplers as described in U.S. Pat. Nos. 3,408,194, 3,447,928, 3,933,501 and 4,022,620, etc. and yellow nitrogen atom releasing couplers as described in Japanese Patent Publication No. 10739/83, U.S. Pat. Nos. 4,401,752 and 4,326,024, *Research Disclosure,* No. 18053 (April, 1979), British Pat. No. 1,425,020, West German Patent Application (OLS) Nos. 2,219,917, 2,261,361, 2,329,587 and 2,433,812, etc. α-Pivaloylacetanilide type couplers are characterized by good fastness, and particularly good light fastness, of the dyes formed, and u-benzylacetanilide type couplers are characterized by a high color density in the dye image formed.

Magenta couplers used in materials processed according to the present invention, include oil protected indazolone type couplers, cyanoacetyl type couplers, and preferably 5-pyrazolone type couplers and pyrazoloazole type couplers such as pyrazolotriazoles. Of 5-pyrazolone type couplers, those substituted with an arylamine group or an acylamino group at the 3-position thereof are preferred in view of the hue and color density of dyes formed. Typical examples thereof are described in U.S. Pat. Nos. 2,311,082, 2,343,703, 2,600,788, 2,908,573, 3,062,653, 3,152,896 and 3,936,015, etc. In two-equivalent 5-pyrazolone type couplers, the nitrogen atom releasing groups as described in U.S. Pat. No. 4,310,619 and the arylthio groups as described in U.S. Pat. No. 4,351,897 are preferred releasing groups. Further, 5-pyrazolone type couplers having a ballast group as described in European Pat. No. 73,636 are advantageous because they provide a high color density.

Examples of pyrazoloazole type couplers include pyrazolobenzimidazoles as described in U.S. Pat. No. 3,369,879, and preferably pyrazolo[5,1-C][1,2,4]triazoles as described in U.S. Pat. No. 3,725,067, pyrazolotetrazoles as described in *Research Disclosure* No. 24230 (June, 1984) and pyrazolopyrazoles as described in *Research Disclosure,* No. 24230 (June, 1984). Imidazo[1,2-b]pyrazoles as described in European Pat. No. 119,741 are preferred and pyrazolo[1,5-b][1,2,4]triazoles as described in European Pat. No. 119,860 are particularly preferred for reducing yellow subsidiary adsorption and improving the light fastness of the dyes formed.

Cyan couplers used in materials processed according to the present invention include oil protected naphthol type and phenol type couplers. Typical examples thereof include naphthol type couplers as described in U.S. Pat. No. 2,474,293 and preferably oxygen atom releasing type two-equivalent naphthol type couplers as described in U.S. Pat. Nos. 4,052,212, 4,146,396, 4,228,233 and 4,296,200, etc. Specific examples of phenol type couplers are described in U.S. Pat. Nos. 2,369,929, 2,801,171, 2,772,162 and 2,895,826, etc.

Cyan couplers fast to humidity and temperature are preferably used in the present invention. Typical examples thereof include phenol type cyan couplers having an alkyl group containing more than one carbon atom at the metaposition of the phenol nucleus as described in U.S. Pat. No. 3,772,002; 2,5-diacylamino-substituted phenol type couplers as described in U.S. Pat. Nos. 2,772,162, 3,758,308, 4,126,396, 4,334,011 and 4,327,173, West German Patent Application (DT-OS) No. 3,329,729, and Japanese Patent Application (OPI) No. 166956/84, etc.; and phenol type couplers having a phenylureido group at the 2-position thereof and an acylamino group at the 5-position thereof as described in U.S. Pat. Nos. 3,446,622, 4,333,999, 4,451,559 and 4,427,767, etc.

Further, couplers capable of forming dyes of controlled diffusibility can be used together in order to improve graininess. Specific examples of such diffusible dye magenta couplers are described in U.S. Pat. No. 4,366,237 and British Pat. No. 2,125,570, etc. and such yellow, magenta and cyan couplers are described in European Pat. No. 96,570 and West German Patent Application (OLS) No. 3,234,533, etc.

These dye forming couplers and special couplers described above may be used in the form of polymers including dimers or higher polymers. Typical examples of dye forming polymer couplers are described in U.S. Pat. Nos. 3,451,820 and 4,080,211, etc. Specific examples of magenta polymer couplers are described in British Pat. No. 2,102,173 and U.S. Pat. No. 4,367,282, etc.

Two or more couplers which can be used in materials processed according to the present invention can be incorporated together in the same layer for the purpose of providing the properties required of the color photographic light-sensitive material, or the same compound can also be incorporated in two or more different layers.

The couplers suitably can be incorporated into the photographic light-sensitive material using an oil drop in water dispersion method. By means of the oil droplet in water dispersion method, couplers are dissolved in either an organic solvent having a high boiling point of about 175° C. or more, an auxiliary solvent having a low boiling point, or a mixture thereof, and then the solution is finely dispersed in an aqueous medium such as water or an aqueous gelatin solution, etc., in the presence of a surface active agent. Specific examples of the organic solvents having a high boiling point are described in U.S. Pat. No. 2,322,027, etc. In order to prepare a dispersion, phase inversion may be accompanied. Further, such dispersions are utilized for coating after removing or reducing the auxiliary solvent therein by distillation, noodle washing or ultrafiltration, etc., if desired.

Specific examples of the organic solvent having a high boiling point include phthalic acid esters (for example, dibutyl phthalate, dicyclohexyl phthalate, di-2-ethylhexyl phthalate, didodecyl phthalate, etc.), phosphoric or phosphonic acid esters (for example, triphenyl phosphate, tricresyl phosphate, 2-ethylhexyl diphenyl phosphate, tricyclohexyl phosphate, tri-2-ethylhexyl phosphate, tridecyl phosphate, tributoxyethyl phosphate, trichloropropyl phosphate, di-2-ethylhexyl phenyl phosphonate, etc.), benzoic acid esters (for example, 2-ethylhexyl benzoate, dodecyl benzoate, 2-ethylhexyl-phydroxybenzoate, etc.), amides (for example, diethyldodecanamide, N-tetradecylpyrrolidone, etc.), alcohols of phenols (for example, isostearyl alcohol, 2,4-di-tertamylphenol, etc.), aliphatic carboxylic acid esters (for example, dioctyl azelate, glycerol tributyrate, isostearyl lactate, trioctyl citrate, etc.), aniline derivatives (for example, N,N-dibutyl-2-butoxy-5-tertoctylaniline, etc.), hydrocarbons (for example, paraffin, dodecylbenzene, diisopropylnaphthalene, etc.), etc. As the auxiliary solvents, organic solvents having a boiling point of about 30° C. or more, preferably from about 50° C. to about 160° C., etc. can be used. Typical examples of such auxiliary solvents include ethyl acetate, butyl acetate, ethyl propionate, methyl ethyl ketone, cyclohexanone, 2-ethoxyethyl acetate, dimethylformamide, etc.

The processess and effects of latex dispersing methods and the specific examples of latexes for impregnation are described in U.S. Pat. No. 4,199,363, West German Patent Application (OLS) Nos. 2,541,274 and 2,541,230, etc.

The color couplers are generally employed in an amount of about 0.001 mol to 1 mol per mol of light-sensitive silver halide contained in the layer to which they are added. It is preferred that the amount of yellow coupler, magenta coupler and cyan coupler used be in a range of about 0.01 mol to 0.5 mol, about 0.003 mol to 0.3 mol and about 0.002 mol to 0.3 mol per mol of light-sensitive silver halide, respectively.

The color photographic light-sensitive material used in the present invention may contain hydroquinone derivatives, aminophenol derivatives, amines, gallic acid derivatives, catechol derivatives, ascorbic acid derivatives, non-color-forming couplers, sulfonamidophenol derivatives, etc., as color fog preventing agents or color mixing preventing agents.

In the color photographic light-sensitive material used in the present invention, various known color fading preventing agents can be employed. Typical examples of organic color fading preventing agents include hindered phenols, for example, hydroquinones, 6-hydroxycoumarones, 5-hydroxycoumarans, spirochromans, p-alkoxyphenols, bisphenols, etc., gallic acid derivatives, methylenedioxybenzenes, aminophenols, hindered amines, or ether or ester derivatives thereof derived from each of these compounds by silylation or alkylation of the phenolic hydroxy group thereof. Further, metal complexes represented by (bis-salicylaldoxymate) nickel complexes and (bis-N,N-dialkyldithiocarbamate) nickel complexes may be employed.

For the purpose of preventing degradation of yellow dye images due to heat, humidity and light, compounds containing both a hindered amine partial structure and a hindered phenol partial structure as described in U.S. Pat. No. 4,268,593 provide good results. For the purpose of preventing degradation of magenta dye images, particularly degradation due to light, spiroindanes as described in Japanese Patent Application (OPI) No. 159644/81 and chromans substituted with a hydroquinone diether or monoether as described in Japanese Patent Application (OPI) No. 89835/80 provide improved results.

In order to improve preservability, and particularly the light fastness of cyan dye images, it is preferred to use a benzotriazole type ultraviolet light absorbing agent in combination with a cyan coupler. Such an ultraviolet light absorbing agent may be emulsified together with a cyan coupler. The coating amount of the ultraviolet light absorbing agent is selected so as to sufficiently improve the light stability of cyan dye images. When the amount of the ultraviolet light absorbing agent employed is too large, yellow coloration may occur in unexposed areas (white background areas) of the color photographic materials. Therefore, the amount is preferably in a range from about $1\times10^{-4}$ mol/m$^2$ to $2\times10^{-3}$ mol/m$^2$, particularly from about $5\times10^{-4}$ mol/m$^2$ to $1.5\times10^{-3}$ mol/m$^2$.

In a color printing paper having a conventional light-sensitive layer structure, the ultraviolet light absorbing agent is incorporated into one of two layers adjacent to a red-sensitive emulsion layer containing a cyan coupler, and preferably to both adjacent layers. When the ultraviolet light absorbing agent is incorporated into an interlayer posisitioned between a green-sensitive emulsion layer and a red-sensitive emulsion layer, it may be emulsified together with a color mixing preventing agent. When the ultraviolet light absorbing agent is added to a protective layer, another protective layer may be separately provided thereon as the outermost layer. In the outermost protective layer, a matting agent having an appropriate grain size, etc. can be incorporated.

The color photographic light-sensitive material used in the present invention may contain an ultraviolet absorbing agent in a hydrophilic colloid layer thereof.

The color photographic light-sensitive material used in the present invention may contain water-soluble dyes as filter dyes, for preventing irradiation or halation, or for other various purposes in a hydrophilic colloid layer thereof, and of these dyes, oxonol dyes, anthraquinone dyes and azo dyes are preferred. Oxonol dyes which absorb green light or red light are particularly preferred.

The color photographic light-sensitive material used in the present invention may contain a brightening agent of the stilbene series, triazine series, oxazoles series, or coumarine series, etc., in photographic emulsion layers or other hydrophilic colloid layers. Water-soluble brightening agents can be employed, and water-insoluble brightening agents may be used in the form of a dispersion.

The present invention can be applied to a multilayer multicolor photographic light-sensitive material having at least two differently spectrally sensitized silver halide photographic emulsion layers on a support, as described above. Multilayer natural color photographic light-sensitive materials usually have at least one red-sensitive silver halide emulsion layer, at least one blue-sensitive silver halide emulsion layer and at least one green-sensitive emulsion layer on a support. The order of the disposition of these emulsion layers can be suitably selected as desired. Further, each of the above described emulsion layers may be composed of two or more emulsion layers having different sensitivities. Moreover, a light-insensitive layer may be present between two more emulsion layers sensitive to the same spectral wavelength range.

In the color photographic light-sensitive materials processed according to the present invention, it is preferred to provide appropriate non-light sensitive layers such as a protective layer, an interlayer, a filter layer, an antihalation layer, a backing layer, etc., in addition to the silver halide emulsion layers.

As the binder or the protective colloid for the photographic emulsion layers or interlayers of the color photographic light-sensitive material processed according to the present invention, gelatin is advantageously used, but other hydrophilic colloids can also be used.

For example, it is possible to use proteins such as gelatin derivatives, graft polymers of gelatin and other polymers, albumin, casein, etc.; saccharides, for example, cellulose derivatives such as hydroxyethyl cellulose, carboxymethyl cellulose, cellulose sulfate, etc., sodium alginate, starch derivatives, etc.; and various synthetic hydrophilic high molecular substances such as homopolymers or copolymers, for example, polyvinyl alcohol, polyvinyl alcohol partial acetal, poly-N-vinylpyrrolidone, polyacrylic acid, polymethacrylic acid, polyacrylamide, polyvinylimidazole, polyvinylpyrazole, etc.

It is particularly effective to use acrylic acid modified polyvinyl alcohol in a protective layer, particularly when an emulsion having a high silver chloride content is subjected to rapid processing.

Suitable gelatins include not only lime-processed gelatin, but also acid-processed gelatin and enzyme-processed gelatin as described in *Bull. Soc. Sci. Phot. Japan,* No. 16, page 30 (1966). Further, hydrolyzed gelatin products or enzymatically decomposed gelatin products can also be used.

Moreover, color photographic light-sensitive materials processed according to the present invention can contain various stabilizers, contamination preventing agents, developing agents or precursors thereof, development accelerating agents or precursors thereof, lubricants, mordants, matting agents, antistatic agents, plasticizers or other conventional additives useful for photographic light-sensitive materials in addition to the above-described additives. Typical examples of these additives are described in *Research Disclosure,* No. 17643 (December, 1978) and ibid., No. 18716 (November, 1979).

These additives are very important in rapid printing and rapid processing, and further in relation to the compound represented by general formula (I). In the present invention, it is particularly effective to use a mercaptoazole compound, a mercaptothiadiazole compound or a mercaptobenzazole compound in a silver halide emulsion having a high silver chloride content from the standpoint of color forming properties and formation of fog.

The term "reflective support" which can be employed in the present invention means a support providing increased reflectiveness for the purpose of making the dye images formed in the silver halide emulsion layer clear. Examples of reflective supports include a support having coated thereon a hydrophobic resin containing a light reflective substance such as titanium oxide, zinc oxide, calcium carbonate, calcium sulfate, etc. dispersed therein, and a support composed of a hydrophobic resin containing a light reflective substance dispersed therein. More specifically, such supports include baryta coated paper, polyethylene coated paper, polypropylene type synthetic paper, a transparent support, for example, a glass plate, a polyester film such as a polyethyleneterephthalate film, a cellulose triacetate film, a cellulose nitrate film, etc., a polyamide film, a polycarbonate film, a polystyrene film, etc. having a reflective layer or having incorporated therein a reflective substance. A suitable support can be appropriately selected depending on the intended use.

The present invention is explained in greater detail with reference to the following examples, but the present invention is not to be construed as being limited thereto. Unless otherwise indicated, all parts, percents and ratios are by weight.

EXAMPLE 1

On a paper support, both surfaces of which were laminated with polyethylene, were coated layers as shown in Table 1-1 below in this order to prepare a multilayer color photographic light-sensitive printing paper. The coating solutions were prepared in the following manner.

Preparation of Coating Solution for First Layer 19.1 g of Yellow Coupler (a) and 4.4 g of Color Image Stabilizer (b) were dissolved in a mixture of 27.2 ml of ethyl acetate and 7.9 ml of Solvent (c) and the resulting solution was dispersed in 185 ml of a 10 wt % aqueous solution of gelatin containing 8 ml of a 10 wt % aqueous solution of sodium dodecylbenzenesulfonate. Separately, to a silver chlorobromide emulsion (having a silver bromide content of 1.0 mol % and containing 70 g of silver per Kg of the emulsion) was added $5.0\times10^{-4}$ mol of a blue-sensitive sensitizing dye shown below per mole of the silver chlorobromide to prepare a blue sensitive emulsion. The above described dispersion was mixed with 90 g of the blue-sensitive silver chlorobromide emulsion, with the concentration of the resulting mixture being controlled with gelatin, to form the composition shown in Table 1-1 below, i.e., the coating solution for the first layer.

Coating solutions for the second layer to the seventh layer were prepared in the same manner as described for the coating solution for the first layer with the substitutions shown below. 2,4-Dichloro-6-hydroxy-s-triazine sodium salt was used as a gelatin hardener in each layer.

The following spectral sensitizers were employed in the respective emulsion layers.

Blue-Sensitive Emulsion Layer

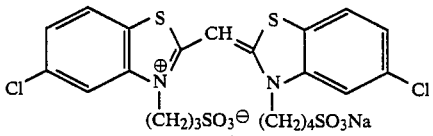

(Amount added: $5.0\times10^{-4}$ mol per mol of silver halide).

Green-Sensitive Emulsion Layer:

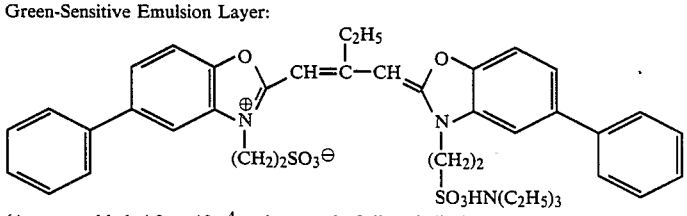

(Amount added: $4.0\times10^{-4}$ mol per mol of silver halide)

-continued

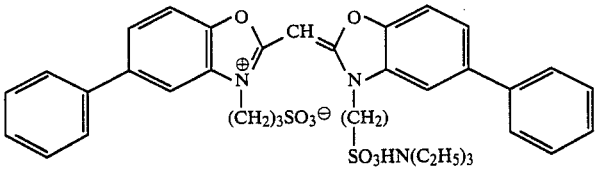

(Amount added: $7.0 \times 10^{-4}$ mol per mol of silver halide).

Red-Sensitive Emulsion Layer:

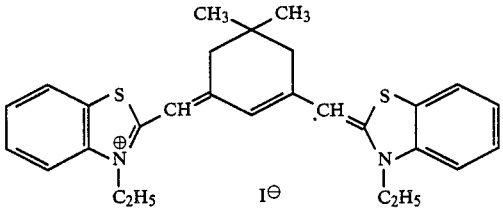

(Amount added: $0.9 \times 10^{-4}$ mol per mol of silver halide).

The following dyes were employed as irradiation preventing dyes in the emulsion layers, respectively.

Green-Sensitive Emulsion Layer:

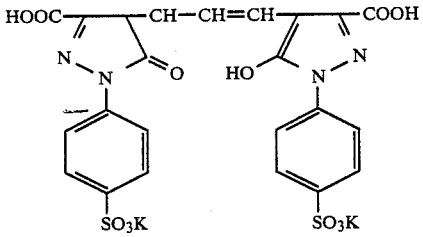

Red-Sensitive Emulsion Layer:

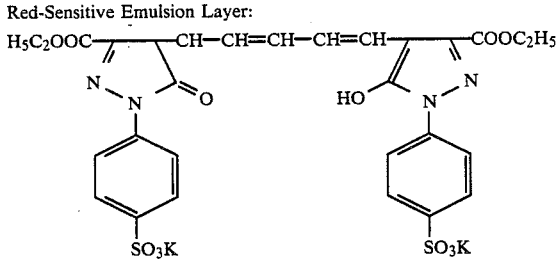

TABLE 1-1

| Layer | Main Composition | Amount Used |
|---|---|---|
| Seventh Layer (Protective layer) | Gelatin | 1.33 g/m$^2$ |
| | Acryl-modified Polyvinyl Alcohol Copolymer (degree of modification: 17%) | 0.17 g/m$^2$ |
| Sixth Layer (Ultraviolet light absorbing layer) | Gelatin | 0.54 g/m$^2$ |
| | Ultraviolet Light Absorbing Agent (h) | 0.21 g/m$^2$ |
| | Solvent (j) | 0.09 ml/m$^2$ |

TABLE 1-1-continued

| Layer | Main Composition | Amount Used |
|---|---|---|
| Fifth Layer (Red-sensitive layer) | Silver Chlorobromide Emulsion (silver bromide: 1.0 mol %) | 0.26 g/m$^2$ (as silver) |
| | Gelatin | 0.98 g/m$^2$ |
| | Cyan Coupler (k) | 0.38 g/m$^2$ |
| | Color Image Stabilizer (l) | 0.17 g/m$^2$ |
| | Solvent (e) | 0.23 ml/m$^2$ |
| Fourth Layer (Ultraviolet light absorbing layer) | Gelatin | 1.60 g/m$^2$ |
| | Ultraviolet Light Absorbing Agent (h) | 0.62 g/m$^2$ |
| | Color Mixing Preventing Agent (i) | 0.05 g/m$^2$ |
| | Solvent (j) | 0.26 ml/m$^2$ |
| Third Layer (Green-sensitive layer) | Silver Chlorobromide Emulsion (silver bromide: 0.5 mol %) | 0.16 g/m$^2$ (as silver) |
| | Gelatin | 1.80 g/m$^2$ |
| | Magenta Coupler (m) | 0.34 g/m$^2$ |
| | Color Image Stabilizer (f) | 0.20 g/m$^2$ |
| | Solvent (g) | 0.68 ml/m$^2$ |
| Second Layer Color mixing preventing layer) | Gelatin | 0.99 g/m$^2$ |
| | Color Mixing Preventing Agent (d) | 0.08 g/m$^2$ |
| First Layer (Blue-sensitive layer) | Silver Chlorobromide Emulsion (silver bromide: 1.0 mol %) | 0.30 g/m$^2$ (as silver) |
| | Gelatin | 1.86 g/m$^2$ |
| | Yellow Coupler (a) | 0.82 g/m$^2$ |
| | Color Image Stabilizer (b) | 0.19 g/m$^2$ |
| | Solvent (c) | 0.34 ml/m$^2$ |
| Support | Polyethylene laminated paper (coated by the polyethylene coating containing a white pigment ($TiO_2$) and a bluish dye (ultramarine) on the first layer side). | |

The compounds used in the above-described layers have the structures shown below, respectively.

Yellow Coupler (a):

-continued
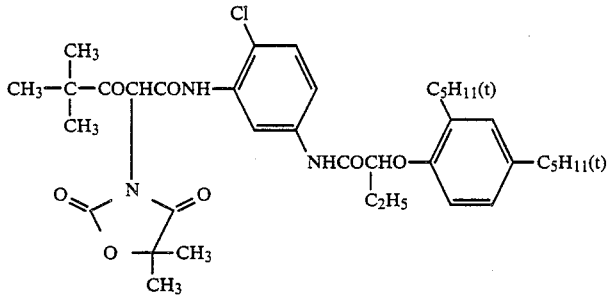
Color Image Stabilizer (b):
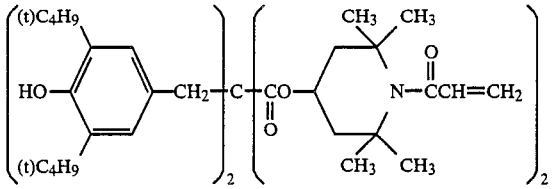
Solvent (c):
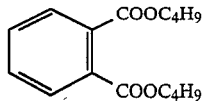
Color Mixing Preventing Agent (d):
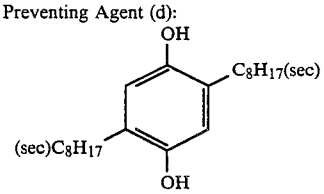
Solvent (e):
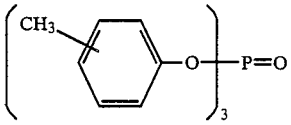
Color Image Stabilizer (f):
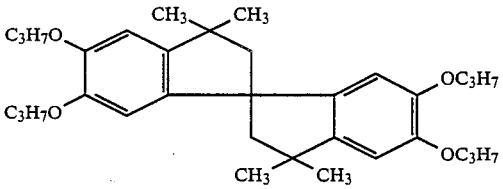
Solvent (g):
A mixture of $g_1$: $(C_8H_{17}O)_3—P=O$ and $g_2$: ( 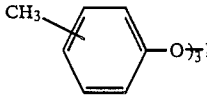 in a ratio of 2/1 by weight ($g_1/g_2$).
Ultraviolet Light Absorbing Agent (h):
A mixture of $h_1$: 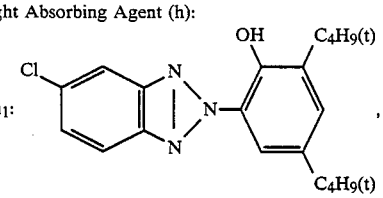 , $h_2$: 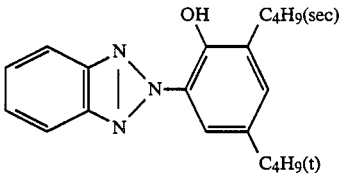 and
$h_3$: 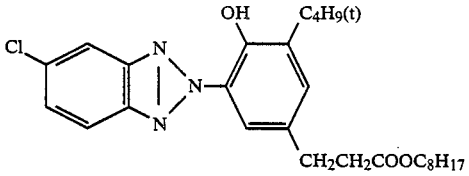 in a molar ratio of 1/5/3 ($h_1/h_2/h_3$).
Color Mixing Preventing Agent (i):
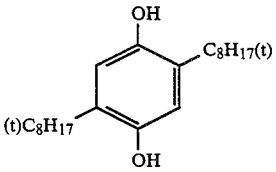

-continued

Solvent (j):

$(iso\ C_8H_{17}O)_3P{=}O$

Cyan Coupler (k):

A mixture of $K_1$:

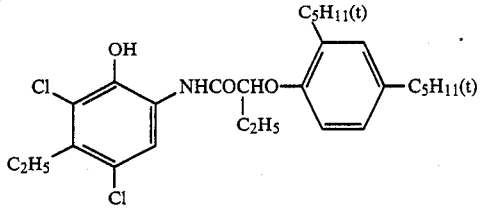

and $k_2$: $(t)C_5H_{11}$

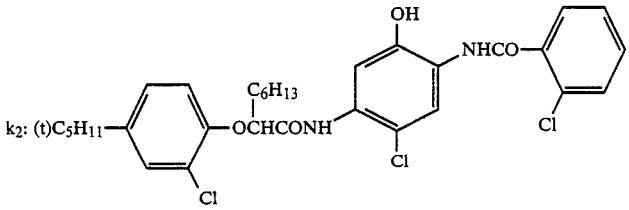

in a molar ratio of 1/1 ($k_1/k_2$).

Color Image Stabilizer (l):

A mixture of $l_1$:

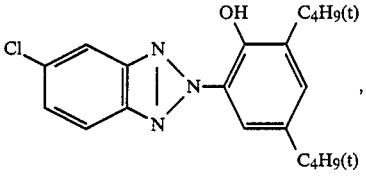

, $l_2$:

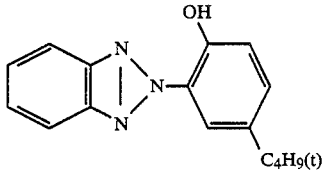

and $l_3$:

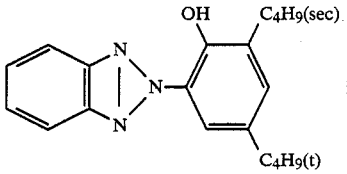

in a molar ratio of 1/3/3 ($l_1/l_2/l_3$).

Magenta Coupler (m):

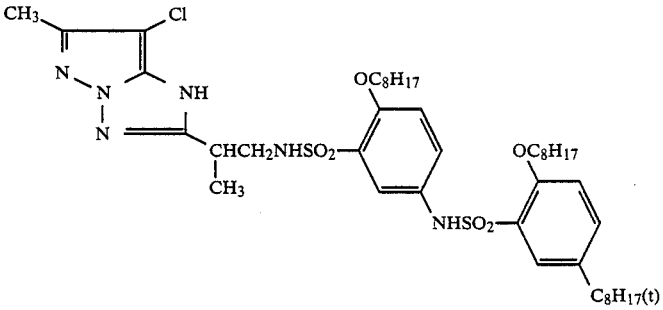

The color paper thus prepared was subjected to wedge exposure and then development processing according to the following processing steps.

| Processing Step | Temperature | Time |
|---|---|---|
| Color Development | 35° C. | 45 sec |
| Bleach-Fixing | 35° C. | 45 sec |
| Rinse 1 | 35° C. | 20 sec |
| Rinse 2 | 35° C. | 20 sec |
| Rinse 3 | 35° C. | 20 sec |
| Drying | 80° C. | 60 sec |

The composition of each processing solution used was as follows.

| Color Developing Solution | | |
|---|---|---|
| N,N—Diethylhydroxylamine | | 4 g |
| Potassium carbonate | | 30 g |
| $EDTA.2Na.2H_2O$ | | 2 g |
| Sodium chloride | | 1.0 g |
| 4-Amino-3-methyl-N—ethyl-N—[β-(methanesulfonamido)ethyl]-p-phenylenediamine sulfate | | 5.0 g |
| Fluorescent whitening agent (4,4'-diaminostilbene type) | | 3.0 g |
| Compound of formula (I) | | Shown in Table 1-2 below |
| Water to make | | 1000 ml |
| | pH | 10.10 |
| **Bleach-Fixing Solution** | | |
| EDTA Fe(III) $NH_4.2H_2O$ | | 60 g |
| $EDTA.2Na.2H_2O$ | | 4 g |
| Ammonium thiosulfate (70 wt % aq. soln.) | | 120 ml |

-continued

| | | |
|---|---|---|
| Sodium sulfite | | 16 g |
| Glacial acetic acid | | 7 g |
| Water to make | | 1000 ml |
| | pH | 5.5 |
| Rinsing Solution | | |
| 1-Hydroxyethylidene-1,1'-diphosphonic acid (60 wt % aq. soln.) | | 1.6 ml |
| Bismuth chloride | | 0.35 g |
| Polyvinyl pyrrolidone | | 0.25 g |
| Aqueous ammonia (26 wt % soln.) | | 2.5 ml |
| Trisodium nitrilotriacetate | | 1.0 g |
| EDTA. 4H | | 0.5 g |
| Sodium sulfite | | 1.0 g |
| 5-Chloro-2-methyl-4-isothiazolin-3-one | | 50 mg |
| Formalin (37 wt % soln.) | | 0.1 ml |
| Water to make | | 1000 ml |
| | pH | 7.0 |

The same color developing solution as described above was allowed to stand in an open 1 liter breaker at 40° C. for 20 days to prepare an aged solution. The above described color development processing was carried out, using both fresh and aged solutions.

The photographic properties obtained by processing with fresh solution and with aged solution are shown in Table 1-2 below, including using $D_{min}$ (minimum density), sensitivity and gradation, of yellow image. The sensitivity point is defined as the optical density value at a defined exposure amount of 100 CMS, and the gradation was defined as the difference in optical density between the exposure producing an optical density of 0.5 and the density produced by an exposure 0.3 log E units higher.

TABLE 1-2

| Experiment No. | Compound | Amount Added (mol/l) | Remark | Fresh Solution $D_{min}$ | Fresh Solution Sensitivity | Fresh Solution Gradation | Aged Solution $D_{min}$ | Aged Solution Sensitivity | Aged Solution Gradation |
|---|---|---|---|---|---|---|---|---|---|
| 1 | — | — | Comparison | 0.11 | 0.62 | 0.72 | 0.18 | 0.61 | 0.80 |
| 2 | Sodium Sulfite | $1.5 \times 10^{-2}$ | " | 0.11 | 0.58 | 0.65 | 0.13 | 0.60 | 0.69 |
| 3 | Triethanolamine | $7 \times 10^{-2}$ | " | 0.11 | 0.63 | 0.71 | 0.15 | 0.65 | 0.76 |
| 4 | Compound I - (1) | " | Present Invention | 0.11 | 0.63 | 0.72 | 0.11 | 0.63 | 0.72 |
| 5 | Compound I - (3) | " | Present Invention | 0.11 | 0.64 | 0.74 | 0.12 | 0.64 | 0.73 |
| 6 | Compound - (5) | " | Present Invention | 0.11 | 0.62 | 0.72 | 0.11 | 0.64 | 0.72 |
| 7 | Compound I - (6) | " | Present Invention | 0.11 | 0.64 | 0.74 | 0.12 | 0.64 | 0.73 |
| 8 | Compound I - (14) | " | Present Invention | 0.11 | 0.63 | 0.73 | 0.11 | 0.63 | 0.72 |

As is apparent from the results shown in Table 1-2 above, using the developer according to the present invention scarcely any change in photographic properties occurred, and consistent results were attained even when the color developing solution was stored open for a long period of time. In contrast, when using a developer containing sodium sulfite or triethanolamine, the photographic properties of the solution changed significantly with the lapse of time, causing increased fog and gradation changes in the photographic images obtained.

EXAMPLE 2

On a paper support, both surfaces of which were laminated with polyethylene subjected to corona discharge treatment, a first layer (the innermost layer) to a seventh layer (the outermost layer) were coated as shown in Table 2-1 below to prepare a sample.

The coating solution for the first layer was prepared in the following manner, using the components specified below.

A mixture of 200 g of a Yellow Coupler, 93.3 g of Color Fading Preventing Agent (r), 10 g of Solvent (p) having a high boiling point, 5 g of Solvent (q) having a high boiling point and 600 ml of ethyl acetate as an auxiliary solvent was dissolved by heating at 60° C. The solution was mixed with 3,300 ml of a 5% aqueous solution containing 330 ml of a 5% aqueous solution of alkanol B (alkylnaphthalenesulfonate manufactured by du Pont Ltd.) and emulsified using a colloid mill to prepare a coupler dispersion. From the dispersion ethyl acetate was distilled off under a reduced pressure and then the dispersion was added to 1,400 g of an emulsion (containing 96.7 g of silver and 170 g of gelatin) containing a sensitizing dye for a blue-sensitive emulsion layer and 1-methyl-2-mercapto-5acetylamino-1,3,4-triazole. Further, 2600 g of a 10 wt % aqueous solution of gelatin was added thereto to prepare the coating solution.

Coating solutions for the second layer to the seventh layer were prepared in the same manner as described for the coating solution for the first layer, with the substitutions indicated below.

TABLE 2-1

| Layer | Composition | |
|---|---|---|
| Seventh Layer (Protective layer) | Gelatin | 600 mg/m$^2$ |
| Sixth Layer (Ultraviolet light absorbing layer) | Ultraviolet light absorbing agent (n) | 260 mg/m$^2$ |
| | Ultraviolet light absorbing agent (o) | 70 mg/m$^2$ |
| | Solvent (p) | 300 mg/m$^2$ |
| | Solvent (q) | 100 mg/m$^2$ |
| | Gelatin | 700 mg/m$^2$ |
| Fifth Layer (Red-sensitive layer) | Silver chlorobromide emulsion (bromide content: 1 mol %) | 210 mg/m$^2$ (as silver) |
| | Cyan coupler (C-2) | 230 mg/m$^2$ |
| | Cyan coupler (C-1) | 170 mg/m$^2$ |
| | Color fading preventing agent (r) | 250 mg/m$^2$ |
| | Solvent (p) | 160 mg/m$^2$ |
| | Solvent (q) | 100 mg/m$^2$ |
| | Gelatin | 1,800 mg/m$^2$ |
| Fourth Layer (Color mixing preventing layer) | Color mixing preventing agent (s) | 65 mg/m$^2$ |
| | Ultraviolet light absorb-agent (n) | 450 mg/m$^2$ |
| | Ultraviolet light absorbing agent (o) | 230 mg/m$^2$ |
| | Solvent (p) | 50 mg/m$^2$ |

TABLE 2-1-continued

| Layer | Composition | |
|---|---|---|
| | Solvent (q) | 50 mg/m$^2$ |
| | Gelatin | 1,700 mg/m$^2$ |
| Third Layer (Green-sensitive layer) | Silver chlorobromide emulsion (bromide content: 3 mol %) | 305 mg/m$^2$ (as silver) |
| | Magenta coupler | 670 mg/m$^2$ |
| | Color fading preventing agent (t) | 150 mg/m$^2$ |
| | Color fading preventing agent (u) | 10 mg/m$^2$ |
| | Solvent (p) | 200 mg/m$^2$ |
| | Solvent (q) | 10 mg/m$^2$ |
| | Gelatin | 1,400 mg/m$^2$ |
| Second Layer | Silver bromide emulsion (Primitive emulsion, grain size: 0.05 m) | 10 mg/m$^2$ (as silver) |
| | Color mixing preventing agent (s) | 55 mg/m$^2$ |
| | Solvent (p) | 30 mg/m$^2$ |
| | Solvent (q) | 15 mg/m$^2$ |
| | Gelatin | 800 mg/m$^2$ |
| First Layer | Silver chlorobromide emulsion (bromide content: 5 mol %) | 290 mg/m$^2$ (as silver) |
| | Yellow coupler | 600 mg/m$^2$ |
| | Color fading preventing agent (r) | 280 mg/m$^2$ |
| | Solvent (p) | 30 mg/m$^2$ |
| | Solvent (q) | 15 mg/m$^2$ |
| | Gelatin | 1,800 mg/m$^2$ |
| Support | Paper support, both surfaces of which were laminated with polyethylene | |

The components used in the material were as follows:

(n) 2-(2-Hydroxy-3,5-di-tert-amylphenyl)benzotriazole
(o) 2-(2-Hydroxy-3,5-di-tert-butylphenyl)benzotriazole
(p) Di-(2-ethylhexyl)phthalate
(q) Dibutyl phthalate
(r) 2,5-di-tert-amylohenyl-3,5-di-tert-butylhydroxybenzoate
(s) 2,5-Di-tert-octylhydroquinone
(t) 1,4-Di-tert-amyl-2,5-di-octyloxybenzene
(u) 2,2'-Methylenebis(4-methyl-6-tert-butylphenol)

Further, the following spectral sensitizing dyes were employed in the emulsion layers, respectively.

Blue-Sensitive Emulsion Layer: Anhydro-5-methoxy-5'-methyl-3,3'-disulfopropylselenacyanine hydroxide Green-Sensitive Emulsion Layer: Anhydro-9-ethyl-5,5'-diphenyl-3,3'-disulfoethyloxacarbocyanine hydroxide Red-Sensitive Emulsion Layer: 3,3'-Diethyl-5-methoxy-9,9'-(2,2-dimethyl-1,3-propane)thiadicarbocyanine iodide As a stabilizer for each emulsion layer, 1-methyl-2-mercapto-5-acetylamino-1,3,4-triazole was employed.

The following irradiation preventing dyes were employed.

4-(3-Carboxy-5-hydroxy-4-(3-(3-carboxy-5-oxo-14-sulfonatophenyl)-2-pyrazolin-4-ylidene)-1-propenyl)-1pyrazolyl)benzenesulfonate dipotassium salt N,N'-(4,8-Dihydroxy-9,10-dioxo-3,7-disulfonato- anthracene-1,5-diyl)bis(aminomethanesulfonate tetrasodium salt.

Moreover, as a hardening agent, 1,2-bis(vinylsulfonyl)ethane was employed.

The couplers employed were as follows:

Yellow Coupler:

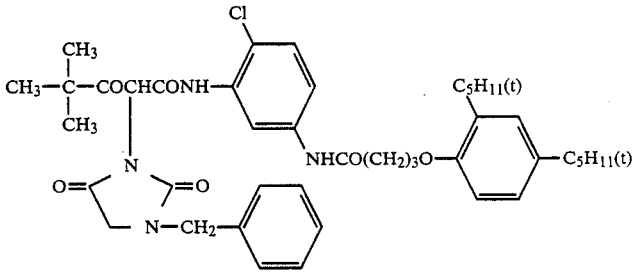

Magenta Coupler:

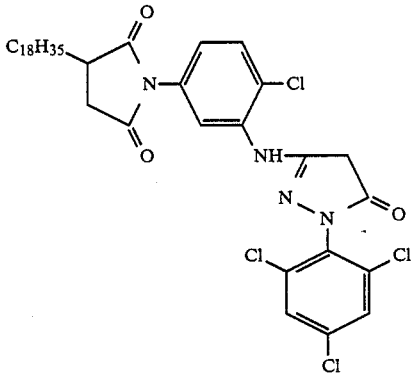

Cyan Coupler:

A mixture of Cyan Coupler C-1-and Cyan Coupler C-2 in a molar ratio of 50/50.

Cyan Coupler C-1:

-continued

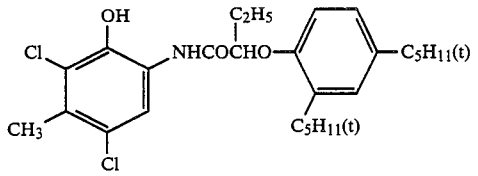

Cyan Coupler C-2:

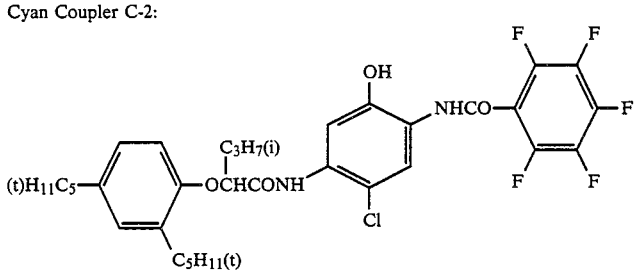

The multilayer color paper thus prepared was subjected to wedge exposure and then development processing according to the following processing steps.

| Processing Step | Time | Temperature |
|---|---|---|
| Color Development | 3 min 30 sec | 33° C. |
| Bleach-Fixing | 1 min 30 sec | 33° C. |
| Rinse (3 tank cascade) | 3 min | 30° C. |
| Drying | 1 min | 80° C. |

The composition of each processing solution was as follows.

| Color Developing Solution | |
|---|---|
| Water | 800 ml |
| Benzyl alcohol | Shown in Table 2-1 |
| Diethylene glycol | Shown in Table 2-1 |
| Diethylenetriaminepentaacetic acid | 1.0 g |
| N,N'—Bis(2-hydroxybenzyl)ethylenediamine-N,N'—diacetic acid | 0.1 g |
| Nitrile-N,N,N—trimethylenephosphonic acid (40 wt %) | 1.0 g |
| Potassium bromide | 1.0 g |
| Compound of formula (I) | Shown in Table 2-1 |
| Hydroxylamine | Shown in Table 2-1 |
| Potassium carbonate | 30 g |
| N—Ethyl-N—(β-methanesulfonamidoethyl)-3-methyl-4-aminoaniline sulfate | 5.5 g |
| Fluorescent whitening agent (4,4'-diaminostilbene type) | 1.0 g |
| Water to make | 1000 ml |
| adjusted pH to 10.10 with potassium hydroxide (KOH) | |

-continued

| Bleach-Fixing Solution | |
|---|---|
| Ammonium thiosulfate (70 wt %) | 150 ml |
| Sodium sulfite | 15 g |
| Ammonium iron (III) ethylenediamine-tetraacetate | 60 g |
| Ethylenediaminetetraacetic acid | 10 g |
| Fluorescent whitening agent (4,4'-diaminostilbee type) | 1.0 g |
| 2-Mercapto-5-amino-3,4-thiadiazole | 1.0 g |
| Water to make | 1000 ml |
| adjusted pH to 7.0 with aqueous ammonia | |
| **Rinsing Solution** | |
| 5-Chloro-2-methyl-4-isothiazolin-3-one | 40 mg |
| 2-Methyl-4-isothiazolin-3-one | 10 mg |
| 2-Octyl-4-isothiazolin-3-one | 10 mg |
| Bismuth chloride (4 wt %) | 0.5 g |
| Nitrilo-N,N,N—trimethylenephosphonic acid (40 wt %) | 1.0 g |
| 1-Hydroxyethylidene-1,1-diphosphonic acid (60 wt %) | 2.5 g |
| Fluorescent whitening agent (4,4'-diaminostilbene type) | 1.0 g |
| Aqueous ammonia (26 wt %) | 2.0 ml |
| Water to make | |
| adjusted pH to 7.5 with potassium hydroxide | |

In the same manner as described in Example 1, $D_{min}$, sensitivity and gradation of magenta image were measured using a fresh developing solution and an aged developing solution. The changes in photographic properties are shown in Table 2-2 below, using the photographic properties obtained by the fresh solution as the standard.

TABLE 2-2

| Experiment No. | Benzyl Alcohol/ Diethylene Glycol (ml/l/ml/l) | Hydroxylamine (0.04 mol/l) | Compound of General Formula (I) (0.1 mol/l) | Remark | Change in Photographic Properties Using Aged Solution | | |
|---|---|---|---|---|---|---|---|
| | | | | | $D_{min}$ | Sensitivity | Gradation |
| 9 | 15/10 | — | — | Comparison | +0.21 | +0.23 | +0.13 |
| 10 | " | II - (5) | — | " | +0.10 | +0.10 | +0.06 |
| 11 | " | II - (34) | Triethanolamine | " | +0.10 | +0.06 | +0.08 |
| 12 | " | — | I - (1) | Present Invention | +0.03 | +0.03 | +0.01 |
| 13 | " | II - (33) | I - (1) | Present Invention | +0.03 | +0.03 | +0.02 |
| 14 | " | II - (5) | I - (1) | Present Invention | +0.02 | +0.02 | 0 |
| 15 | " | II - (5) | I - (5) | Present Invention | +0.01 | +0.01 | 0 |
| 16 | — | II - (5) | — | Comparison | +0.08 | +0.08 | +0.06 |
| 17 | — | II - (34) | Triethanolamine | " | +0.09 | +0.06 | +0.07 |
| 18 | — | — | I - (1) | Present | +0.02 | +0.02 | +0.01 |

TABLE 2-2-continued

| Experiment No. | Benzyl Alcohol/ Diethylene Glycol (ml/l/ml/l) | Hydroxylamine (0.04 mol/l) | Compound of General Formula (I) (0.1 mol/l) | Remark | Change in Photographic Properties Using Aged Solution $D_{min}$ | Sensitivity | Gradation |
|---|---|---|---|---|---|---|---|
| 19 | — | II - (33) | I - (1) | Invention Present | +0.01 | +0.01 | 0 |
| 20 | — | II - (5) | I - (1) | Invention Present | 0 | 0 | 0 |
| 21 | — | II - (33) | I - (5) | Invention Present | +0.01 | +0.01 | 0 |
| 22 | — | II - (5) | I - (5) | Invention Present | 0 | 0 | 0 |

As is apparent from the results shown in Table 2-2 above, though the developing solution compositions according to the present invention produce excellent results in the system containing benzyl alcohol, extremely stable photographic properties can particularly be obtained when they are used in the system which does not contain benzyl alcohol (compare Experiment Nos. 12, 13, 14, and 15, with Nos. 18, 19, 20, 21 and 22). In contrast when using hydroxylamine alone, the developing solution changed with the lapse of time and large changes in photographic properties occurred.

EXAMPLE

A color paper was prepared in the same manner as described in Example 2 except for using a silver chlorobromide emulsion having a silver bromide content of 80 mol % in place of the emulsion used in the third layer. Using this color paper, the change in photographic properties was determined in the same manner as described in Experiment Nos. 9 to 22 in Example 2.

As a result, the photographic properties changed remarkably using the aged developing solution containing hydroxylamine alone, just as in Example 2. The developing solution compositions according to the present invention exhibited excellent stability, particularly in the system which did not contain benzyl alcohol.

EXAMPLE 4

The color paper as described in Example 1 was subjected to wedge exposure and then processed according to the steps shown below using the color developing solution according to the present invention, conducting a running processing (continuous processing) test until the amount of replenishment reached 3 times of the capacity of tank.

| Processing Step | Temperature | Time | Amount of Replenishment |
|---|---|---|---|
| Color Development | 35° C. | 45 sec | 160 ml/m$^2$ |
| Bleach-Fixing | 35° C. | 45 sec | 100 ml/m$^2$ |
| Rinse (1) | 30° C. | 20 sec | |
| Rinse (2) | 30° C. | 20 sec | |
| Rinse (3) | 30° C. | 20 sec | 200 ml/m$^2$ |
| Drying | 60-70° C. | 30 sec | |

The rinse steps were carried out using a three tank countercurrent process from Rinse (3) to Rinse (1).

The composition of each processing solution was as follows.

| | Tank Solution | Replenisher |
|---|---|---|
| Color Developing Solution | | |
| Compound I-(13) | 0.03 mol | 0.03 mol |
| Hydroxylamine Compound II-(5) | 0.04 mol | 0.04 mol |
| Fluorescent whitening agent (4,4'-diaminostilbene type) | 3.0 g | 4.0 g |
| EDTA | 1.0 g | 1.5 g |
| Potassium carbonate | 30.0 g | 30.0 g |
| Sodium chloride | 1.4 g | 0.1 g |
| 4-Amino-3-methyl-N—ethyl-N—[β-(methanesulfonamido)ethyl]-p-phenylenediamine sulfate | 5.0 g | 7.0 g |
| Benzyl alcohol | 15 ml | 20 ml |
| Diethylene glycol | 10 ml | 10 ml |
| 1,2-Dihydroxybenzene-3,4,6-trisulfonic acid | 300 mg | 300 mg |
| Water to make | 1000 ml | 1000 ml |
| pH | 10.10 | 10.50 |
| Bleach-fixing Solution (Tank Solution and Replenisher) | | |
| EDTA.Fe(III) | 60 g | |
| EDTA.2Na.2H$_2$O | 4 g | |
| Ammonium thiosulfate (70 wt %) | 120 ml | |
| Sodium sulfite | 16 g | |
| Glacial acetic acid | 7 g | |
| Water to make | 1000 ml | |
| pH | 5.5 | |

Rinsing Solution (Tank Solution and Replenisher)

City water was treated by being passed through a column filled with an H type strong acidic cation exchange resin (Diaion SK-1B manufactured by Mitsubishi Chemical Industries Ltd.) and an OH type strong basic anion exchange resin (Diaion SA-10A manufactured by Mitsubishi Chemical Industries Ltd.) to provide the water quality shown below, and 20 mg/l of sodium dichloroisocyanurate was added thereto as a disinfectant.

Calcium ion: 1.1 mg/l
Magnesium ion: 0.5 mg/l
pH: 6.9

The B, G and R densities (stain) in an unexposed area were measured using a Fuji type automatic recording densitometer for a sample at the start of the running processing and a sample at the end of the running processing. Further, the sample at the end of the running processing was stored at 80° C. and 5 to 10% RH for 1 month and then the B, G and R densities in unexposed areas were once again measured.

As a result, it was found that the increase in stain at the end of the running processing period was extremely small based on that at the start of the running processing, and that the increase in stain was also extremely small in the sample after being stored under high temperature conditions.

Thus, the developing solution composition for a silver halide color photographic material according to the present invention provides a color developing solution which is excellent in stability and color formation and remarkably limits fog formation during continuous processing.

Further, the developing solution composition according to the present invention has these advantages to a greater extent when it is employed in a system substantially free from benzyl alcohol.

By the use of the developing solution composition according to the present invention, the stability of a color developing solution can be increased without employing a substance such as a sulfite ion, which competes with the developing agent, thus preventing the degradation of color forming properties.

While the invention has been described in detail and with reference to specific embodiments thereof, it will be apparent to one skilled in the art that various changes and modifications can be made therein without departing from the spirit and scope thereof.

What is claimed is:

1. A developing solution composition for a silver halide color photographic material comprising an aromatic primary amine color developing agent; a compound represented by formula (I):

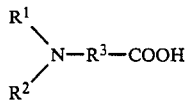

(I)

wherein $R^1$ and $R^2$, which may be the same or different, each represents a hydrogen atom or a substituted or unsubstituted alkyl group having from 1 to 10 carbon atoms; $R^3$ represents a substituted or unsubstituted alkylene group having from 1 to 10 carbon atoms; and the total number of carbon atoms contained in $R^1$, $R^2$ and $R^3$ is at least 3; and further a hydroxylamine represented by formula (II):

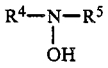

(II)

wherein $R^4$ and $R^5$, which may be the same or different, each represents a hydrogen atom, an unsubstituted or substituted alkyl group, an unsubstituted or substituted alkenyl group or an unsubstituted or substituted aryl group, provided that the total number of carbon atoms included in $R^4$ or $R^5$ is from 1 to 10, and $R^4$ and $R^5$ may be connected to form a heterocyclic ring together with the nitrogen atom.

2. The developing solution composition as claimed in claim 1, wherein $R^1$ and $R^2$ each represents a hydrogen atom, an unsubstituted alkyl group, a hydroxyalkyl group, an alkoxyalkyl group or a carboxyalkyl group, having from 1 to 10 carbon atoms; and $R^3$ represents an unsubstituted alkylene group or an alkylene group substituted with a carboxy group, an amino group or a hydroxy group, having from 1 to 10 carbon atoms.

3. The developing solution composition as claimed in claim 1, wherein at least one of $R^1$ and $R^2$ represents a hydrogen atom, an unsubstituted alkyl group or a hydroxyalkyl group, having from 1 to 10 carbon atoms, and $R^3$ represents an unsubstituted alkylene group or an alkylene group substituted with a carboxy group, an amino group or a hydroxy group, having from 1 to 10 carbon atoms.

4. The developing solution composition as claimed in claim 1, wherein the total number of carboxy groups contained in the compound represented by formula (I) is from 1 to 3.

5. The developing solution composition as claimed in claim 1, wherein the compound represented by formula (I) is contained in a amount of from about 0.01 g to 50 g per liter of said solution, and the aromatic primary amine color developing agent contains in an amount of from about 0.1 g to about 20 g per liter of said solution.

6. The developing solution composition as claimed in claim 1, wherein the aromatic primary amine color developing agent is a p-phenylenediamine developing agent.

7. The developing solution composition as claimed in claim 1, wherein the substituent for each substituted group represented by $R^4$ or $R^5$ is selected from the group consisting of a hydroxy group, an alkoxy group, an alkylsulfonyl group, an arylsulfonyl group, an amide group, a carboxy group, a cyano group, a sulfo group, a nitro group and an amino group.

8. The developing solution composition as claimed in claim 1, wherein the compound represented by formula (II) is contained in an amount of from about 0.1 g to 20 g per liter of said solution.

9. The developing solution composition as claimed in claim 1, wherein said color developing solution contains benzyl alcohol in an amount of not more than 2 ml per liter of said solutions.

10. The developing solution composition as claimed in claim 1, wherein said color developing solution contains no benzyl alcohol.

11. The developing solution composition as claimed in claim 4, wherein the total number of the carboxy groups is from 1 to 2.

12. A method for processing a silver halide color photographic material comprising the step of developing a silver halide color photographic material comprising a support having thereon at least one silver halide emulsion layer with a developing solution comprising an aromatic primary amine color developing agent; a compound represented by formula (I):

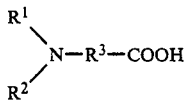

(I)

wherein $R^1$ and $R^2$, which may be the same or different, each represents a hydrogen atom or a substituted or unsubstituted alkyl group, having from 1 to 10 carbon atoms, $R^3$ represents a substituted or unsubstituted alkylene group, having from 1 to 10 carbon atoms, and the total number of carbon atoms contained in $R^1$, $R^2$ and $R^3$ is at least 3,; and further a hydroxylamine represented by formula (II):

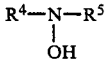

(II)

wherein $R^4$ and $R^5$, which may be the same or different, each represents an unsubstituted or substituted alkyl group, an unsubstituted or substituted alkenyl group or an unsubstituted or substituted aryl group, provided that the total number of carbon atoms included in $R^4$ or $R^5$ is from 1 to 10, and $R^4$ and $R^5$ may be connected to from a heterocyclic ring together with the nitrogen atom.

13. The method for processing a silver halide color photographic material as claimed in claim 12, wherein the color developing solution contains no benzylalcohol or benzyl alcohol in an amount of not more than 2 ml per liter of said solution.

14. The method for processing a silver halide color photographic material as claimed in claim 12, wherein said developing solution contains the compound represented by formula (I) in an amount of from about 0.01 g to 50 g per liter of said solution, and said aromatic primary amine color developing agent in an amount of from about 0.1 g to 20 g per liter of said solution.

15. The method for processing a silver halide color photographic material as claimed in claim 14, wherein said developing solution contains the compound represented by formula (I) in an amount of from about 0.1 g to 20 g per liter of said solution, and said aromatic primary amine color developing agent in an amount of from about 0.5 g to 10 g per liter of said solution.

* * * * *